US007359651B2

(12) United States Patent
Nishitani et al.

(10) Patent No.: US 7,359,651 B2
(45) Date of Patent: Apr. 15, 2008

(54) IMAGE FORMING APPARATUS

(75) Inventors: Hitoshi Nishitani, Tokyo (JP); Hiroyuki Takahashi, Toride (JP); Takao Ogata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 296 days.

(21) Appl. No.: 11/330,181

(22) Filed: Jan. 12, 2006

(65) Prior Publication Data

US 2006/0165423 A1 Jul. 27, 2006

(30) Foreign Application Priority Data

Jan. 18, 2005 (JP) ..... 2005-010966

(51) Int. Cl.
*G03G 15/08* (2006.01)

(52) U.S. Cl. ..... 399/27; 399/119; 399/258; 399/260

(58) Field of Classification Search ..... 399/27, 399/107, 119, 252, 258, 260
See application file for complete search history.

(56) References Cited

U.S. PATENT DOCUMENTS

| | | | | |
|---|---|---|---|---|
| 5,559,587 | A | 9/1996 | Ogata et al. | 355/246 |
| 5,636,010 | A | 6/1997 | Danzuka et al. | 399/300 |
| 5,999,777 | A | 12/1999 | Masuda et al. | 399/222 |
| 6,795,660 | B2 * | 9/2004 | Yugeta et al. | 399/27 |
| 7,046,945 | B2 | 5/2006 | Nishitani et al. | 399/254 |
| 7,106,981 | B2 * | 9/2006 | Hashimoto et al. | 399/25 |
| 7,110,707 | B2 | 9/2006 | Nishitani | 399/258 |
| 7,242,872 | B2 * | 7/2007 | Okamoto et al. | 399/12 |
| 7,277,663 | B2 * | 10/2007 | Kimijima et al. | 399/167 |
| 2006/0104670 | A1 | 5/2006 | Nishitani et al. | 399/258 |

FOREIGN PATENT DOCUMENTS

JP 3060562 6/1999

OTHER PUBLICATIONS

Computer-Generated Translation of Japanese Registered Utility Model No. 3060562.

* cited by examiner

*Primary Examiner*—Hoan Tran
(74) *Attorney, Agent, or Firm*—Fitzpatrick, Cella, Harper & Scinto

(57) ABSTRACT

The image forming apparatus includes first and second developing apparatuses for developing electrostatic images on first and second image bearing members, a first developer container containing a developer, first supplying device for supplying the developer in the first developer container to the first developing apparatus, a second developer container containing a developer to be supplied to the second developing apparatus, second supplying device for supplying the developer in the second developer container to the second developing apparatus, driving device for driving the first and second supplying device, changeover device which changes over the driving force of the driving device during one image forming operation to first and second states in which the driving force is respectively transmitted to each of the first and second supplying device, and control device for changing the times of the first and second states according to a condition of an image to be formed.

17 Claims, 19 Drawing Sheets

IMAGE FORMING APPARATUS

BACKGROUND OF THE INVENTION

1. Field of the Invention

This invention relates to an image forming apparatus such as a copying machine, a facsimile apparatus or a printer for forming an electrostatic image on an image bearing member, for example, by an electrophotographic printing method, an electrostatic recording method or the like, and visualizing this electrostatic image as a visible image (toner image) with a developer contained in a developing apparatus, and particularly to an image forming apparatus provided with a developer supplying apparatus for supplying a developer to be supplied to a developing apparatus.

2. Related Background Art

In image forming apparatus such as a copying machine, a facsimile apparatus and a printer, there is well known a method of carrying a dry type developer as a visualizing agent on the surface of a developer carrying member, carrying and supplying the developer to the vicinity of an image bearing member bearing an electrostatic image thereon, and developing and visualizing the electrostatic image by an alternating electric field which alternately applies electrolysis to between the image bearing member and the developer carrying member, and it is usual that a developing sleeve is used as the developer carrying member and a photosensitive drum is used as the image bearing member.

As the developing method, there is known, for example, a so-called magnetic brush developing method of using a developer which is of two-component composition including toner particles and carrier particles (a so-called two-component developer), forming a magnetic brush on the surface of a developing sleeve having a magnet disposed therein, bringing this magnetic brush into frictional contact with or proximity to a photosensitive drum opposed to the developing sleeve with a minute developing gap held therebetween, and continuously applying an alternating electric field to between the developing sleeve and the photosensitive drum (between S-D) to thereby repetitively effect the shift of the toner particles from the developing sleeve side to the photosensitive drum side and the reverse shift thereof and accomplish developing.

For example, in an image forming apparatus using the two-component developer as described above, the toner is consumed with image formation and therefore, it is necessary to suitably supply the toner to a developing apparatus.

The construction of a developing apparatus for two-component magnetic brush development, and of a developer supplying apparatus for supplying a developer to the developing apparatus will hereinafter be described with reference to FIGS. 16A and 16B of the accompanying drawings. FIGS. 16A and 16B schematically show the cross sections of the developing apparatus and the developer supplying apparatus, respectively.

The developing apparatus 4 has, in a developer container (developing apparatus main body) 41, a developing sleeve 46 as a developer carrying member, a magnet roller 47 as magnetic field generating means fixedly disposed in the developing sleeve 46, a developing screw 44 and an agitating screw 45 as developer agitating means for agitating and carrying the developer in the developer container 41, a toner receiving hole 49, and a regulating blade 48 disposed to form the developer as a thin layer on the surface of the developing sleeve 46.

The interior of the developer container 41 is substantially divided into two, i.e., a developing chamber 42 and an agitating chamber 43. The developing screw 44 is disposed in the developing chamber 42, and the agitating screw 45 is disposed in the agitating chamber 43. As shown, the developing sleeve 46 is disposed in proximity to the photosensitive drum 1, and is set so as to be rotated in an opposite direction to (or the same direction as) the photosensitive drum, and be capable of effecting development with the developer D being in contact with the photosensitive drum 1.

The developer supplying apparatus 50 has a sub-toner container (first developer container 51 storing therein a developer (toner) to be supplied to the developing apparatus 4. Above the sub-toner container 51, there is formed a toner supply port 60 which can receive the supply of the toner.

Also, below the sub-toner container 51, a toner carrying pipe 52 which can carry the toner from the sub-toner container 51 is cylindrically formed while protruding in a substantially horizontal direction. In the toner carrying pipe 52, there is rotatably provided a supply screw (first supplying means) 53 having a spiral surface formed on the rotary shaft thereof. The supply screw 53 has connected thereto driving means 54 for rotatively driving this supplying screw 53.

Also, in the sub-toner container 51, there is provided a toner sensor (toner presence or absence detecting sensor) 56 for electrically or optically directly detecting the presence or absence of the toner. Further, in the sub-toner container 51, there is rotatably or pivotally movably provided an agitating member 55.

The developer supplying apparatus 50 further has a main toner container (second developer container) 57 provided above the sub-toner container 51 for storing therein the toner to be supplied to the sub-toner container 51. In the main toner container 57, there is rotatably provided an agitating and carrying member (second supplying means) 58. The agitating and carrying member 58 has connected thereto driving means 59 for rotatively driving this agitating and carrying member 58.

The main toner container 57 can also be made detachably mountable with respect to the sub-toner container 51 and an image forming apparatus main body, and is generally called a toner cartridge (or a toner bottle).

An image forming operation in the developing apparatus will now be described.

A two-component developer comprising a mixture of nonmagnetic toner particles (toner) and magnetic carrier particles (carrier) is contained in the developer container 41. The mixing ratio of the toner(T) to the carrier(C) (hereinafter referred to as the "T/C ratio") is kept constant by an amount of toner corresponding to an amount of toner consumed by development. That is, the toner is caused to fall from the sub-toner container 51 in which the toner to be supplied is stored into the agitating chamber 43 in which the agitating screw 45 is provided via the receiving hole 49 of the developer container 41, by the supply screw 53, and is supplied to the developing apparatus 4. As methods of detecting and maintaining the T/C ratio of the developer in the developer container 41 at this time, various methods have heretofore been put into practical use.

Description will hereinafter be made of the operation of replenishing the sub-toner container 51 with the toner when the toner in the sub-toner container 51 has been decreased with the consumption of the toner.

The agitating member 55 has the action of performing rotation or pivotal movement to thereby take the toner to pieces in order to prevent the toner from lumping in the sub-toner container 51. Also, the supplying screw 53 is provided to act to carry the toner in the sub-toner container 51 in a longitudinal direction (a direction parallel to the plane of the drawing sheet of FIGS. 6A and 6B) toward the hole 49 communicating with the developer container 41 and to act to push the toner out of the hole and cause it to fall into the developer container 41. In a case where the toner sensor 56 detects the absence of the toner, whereafter the toner sensor 56 still detects the absence of the toner in spite of the operation of the agitating member 55, it is judged that the toner does not lump in a portion of the toner container 51 but has become truly absent.

Once it is judged that the toner is truly absent in the sub-toner container 51, the agitating and carrying member 58 in the main toner container 57 is rotated, whereby the toner is supplied from the main toner container 57 to the sub-toner container 51. The agitating and carrying member 58 is provided to act to be rotated to thereby take the toner to pieces in order to prevent the toner from lumping in the main toner container 57, to act to carry the toner in the main toner container 57 in a longitudinal direction (the direction parallel to the plane of the drawing sheet of FIGS. 16A and 16B) toward the toner supply port 60 communicating with the sub-toner container 51, and to act to push the toner out of the supply port 60 and cause it to fall into the sub-toner container 51, and it is usual to use, for example, a sheet material of PET or the like as this member.

The rotation of the agitating and carrying member 58 in the main toner container 57 continues until the toner sensor 56 detects the presence of the toner, and after the toner sensor 56 has detected the presence of the toner, the supply of the toner is continuedly effected from the sub-toner container 51 via the supply screw 53.

Description has been made here of a case where the agitating and carrying member 58 is rotated after the toner sensor 56 has detected the absence of the toner, but since the agitating and carrying member 58 is a sheet material, it does not push the toner into the sub-toner container 51 more than necessary and therefore, even before the toner sensor detects the absence of the toner, there is no problem even if the agitating and carrying member 58 is rotated.

Also, when the toner sensor 56 does not detect the presence of the toner even if the agitating and carrying member 58 in the main toner container 57 is rotated for a sufficient time, it can be judged that the toner is not supplied to the sub-toner container 51, that is, the toner has also become absent in the main toner container 57. The absence of the toner is informed to a user through display means such as an operation panel, not shown.

The main toner container 57 is made detachably mountable in one case, and is fixed to the apparatus in another case. In the case where it is made detachably mountable, the main toner container 57 is generally called a toner cartridge, and when the toner therein has become absent, as described above, the main toner container 57 is bodily interchanged to thereby fill it with the toner. Also, in the case where it is fixed to the apparatus, the main toner container 57 is filled with the toner directly from a discrete toner container.

The supply screw 53 is rotated by the driving means 54, and the number of revolutions or the rotation time thereof is set in conformity with the amount of toner required by the developing apparatus, and when the set number of revolutions or rotation time is reached, the rotation thereof is stopped, whereby it carries the amount of toner required by the developing apparatus, and supplies the toner to the developer container. At this time, the amount of toner to be carried per rotation or per unit time is made into a constant in advance in conformity with the sizes of the respective toner supply screws, and the control of calculating the number of revolutions or the rotation time in conformity with the required amount is possible.

Here, the amount of toner carried by the screw is proportional to the number of revolutions of the screw and therefore, to set it by the rotation time, it becomes a premise that the driving means for the screw be always rotatable at a constant speed. Also, if provision is made of means for counting the number of revolutions of the screw, it is possible to set the amount of toner to be carried by the screw by the number of revolutions even if the rotating speed of the screw is constant.

In FIGS. 16A and 16B, in order to make the figures easily seen, the longitudinal direction of the photosensitive drum 1 and the developing apparatus 41 is depicted in a direction perpendicular to the plane of the drawing sheet, and the longitudinal direction of the sub-toner container 51, the supplying screw 53 and the main toner container 57 is depicted in a direction parallel to the plane of the drawing sheet, but actually it is usual that these longitudinal directions are the same directions. Description will now be made of a driving mechanism for the developer supplying apparatus 50.

FIG. 17 of the accompanying drawings schematically shows the construction of the developing apparatus 4 and the driving mechanism 50 for the developer supplying apparatus 50.

As described above, the developing apparatus 4 can develop the electrostatic image on the photosensitive drum 1 as a visible image by the use of the developer stored therein. That is, the developing apparatus 4 has the developing screw 44 and the agitating screw 44 and the agitating screw 45 which are developer agitating means for agitating and carrying the developer in the developing apparatus 4. Also, the developer supplying apparatus 50, as described above, has the sub-toner container 51 which is the first developer container storing therein the toner to be supplied to the developing apparatus 4, the supply screw 53 which is the first supplying means for discharging the toner from the sub-toner container 51 and supplying it to the developing apparatus 4, the main toner container 57 which is the second developer container storing therein the toner to be supplied to the sub-toner container 51, and the agitating and carrying member 58 which is the second supplying means for discharging the toner from the main toner container 57 and supplying it to the sub-toner containers 51.

The driving mechanism 200 for the developer supplying apparatus 50 has a motor 80 which is rotatively driving means capable of transmitting a drive to the supplying screw 53, and a drive gear train GA as rotation transmitting means capable of transmitting the rotation of the motor 80 to the supplying screw 53. The agitating and carrying member 58 can transmit a drive from the motor 80 to the drive gear 59 through a drive gear train (not shown) provided with a clutch mechanism, as required, and can also be driven by the use of a motor discrete from the motor 80.

Further describing, the drive gear train GA has a first drive gear 81 on the motor 80 side, and a second drive gear 82 meshing with this first drive gear 81, and the second drive gear 82 is in meshing engagement with a screw driving gear 54 for driving the supply screw 53.

Control means 90 controls the rotation and stoppage of the motor 80. Also, the control means 90 controls the rotation of the developer agitating means of the developing apparatus, i.e., the developing screw 44 and the carrying screw 45, and as described above, the supply screw 53 and further, the agitating and carrying member 58.

When by the construction as described above, the supply screw 53 is to be rotated to thereby supply the toner from the sub-toner container 51 to the developing apparatus 4, the motor 80 is rotated. Thereby, it is possible to rotate the supplying screw 53 while keeping the agitating and carrying member 58 stopped. Also, it is possible to rotate the agitating and carrying member 58 while keeping the supply screw 53 stopped.

FIG. 18 of the accompanying drawings shows the layout of the driving construction of the developing apparatuses 4 (4Y, 4M, 4C, 4K) and the developer supplying apparatuses 50 (50Y, 50M, 50C, 50K) in respective image forming stations P (PY, PM, PC, PK) in an image forming apparatus 100 of a four-set tandem type. The developing apparatuses 4 and the developer supplying apparatuses 50 for a first color, a second color, a third color and a fourth color, and driving mechanisms 200 (200Y, 200M, 200C, 200K) therefor are the same as the constructions shown in FIG. 17. As shown in FIG. 18, the developing apparatuses 4 (4Y, 4M, 4C, 4K) and the developer supplying apparatuses 50 (50Y, 50M, 50C, 50K) for the four colors are provided in rows, whereby full-color printing is possible.

In the case of this system, an intermediate transfer member (intermediate transfer medium) 7 or a recording material (recording paper) is moved in the direction of arrow and images of the respective colors are superposed thereon and therefore, an image forming operation is performed with each color delayed by a time for which the intermediate transfer member 7 or the recording material is moved by a shown dimension Q.

The photosensitive drums 1 (1Y, 1M, 1C, 1K) are in contact with the recording paper or the intermediate transfer member and therefore are always rotated, but it is usual that the agitating screw 45 and the developing screw 44 as the developer agitating means in the developing apparatus 4 are rotated only for a necessary time during the image forming operation in order to minimize the deterioration of the developer. If the operation of supplying the toner from the sub-toner container to the developing apparatus is performed with the agitating screw and the developing screw in the developing apparatus 4 remaining stopped, the supplied toner stagnates near the supply port to thereby cause the clogging of the toner and the non-uniformity of the T/C ratio in the developing apparatus and therefore, it is requisite that the operation of supplying the toner from the sub-toner container to the developing apparatus be performed by all means with the agitating screw and the developing screw in the developing apparatus being rotated.

FIG. 19 of the accompanying drawings shows the time for which the agitating screw and the developing screw in the developing apparatus are rotated, and the letter T corresponds to the time for which the recording paper or the intermediate transfer member is moved by the dimension Q in FIG. 18. Thus, as shown in FIG. 19, during the time when the agitating screw and the developing screw in the developing apparatus for each color are rotated, the supply screw as the toner supplying means of the corresponding developer supplying apparatus is rotated to thereby perform the operation of supplying the toner from the sub-toner container to the developing apparatus.

The conventional image forming apparatus has required a number of motors providing the rotative driving sources of the supply screws for supplying the toner from the sub-toner container to the developing apparatus at optimum timing for each color which correspond to the number of the supply screws.

Therefore, assuming that multiplex development of four colors is to be effected, four motors have been necessary only for driving the supplying means. For example, it is possible to make some motors common to one another and utilize an electromagnetic clutch to change over rotation and stoppage, but of course, after all, an electromagnetic clutch becomes necessary in place of the motors.

For example, Japanese Registered Utility Model No. 3060562 discloses a developer supplying mechanism of a construction in which by a single driving motor, a driving side is selected and changed over depending on the rotation direction of the motor, to thereby drive the respective developer supplying rollers of two toner containers. Also, as the drive changeover method, use is made of a rockable gear, a one-way clutch or the like. By this construction, it is possible to decrease the number of motors.

Japanese Registered Utility Model No. 3060562, however, bears no description about the relation between the rotated state of the agitating screw and the developing screw in the developing apparatus and the operated state of the supply screw of the developer supplying apparatus, i.e., the drive changeover timing.

According to the results of our numerous studies and experiments, it has been found that to suppress the scattering of the developer, background fog and density fluctuation due to the faulty agitation of the developer, and obtain a good image, it is very important to optimize the drive changeover timing in conformity with various kinds of information.

SUMMARY OF THE INVENTION

It is an object of the present invention to provide an image forming apparatus in which the supply of a developer to be supplied from two developer supplying apparatuses by a single drive source is effected by drive changeover, wherein developer supply conforming to an image to be formed can be effected.

It is another object of the present invention to provide an image forming apparatus provided with a first developing apparatus for developing an electrostatic image formed on a first image bearing member with a developer, a second developing apparatus for developing an electrostatic image formed on a second image bearing member disposed on a downstream side with respect to a direction in which a transfer medium to which a developer image is transferred is conveyed, with a developer, a first developer container containing therein a developer to be supplied to the first developing apparatus, first supplying means for supplying the developer to be supplied in the first developer container to the first developing apparatus, a second developer container containing therein a developer to be supplied to the second developing apparatus, second supplying means for supplying the developer to be supplied in the second developer container to the second developing apparatus, driving means for generating a driving force for driving the first supplying means and the second supplying means, changeover means capable of changing a driving force of said driving means over in at least two states including a first state and a second state during one image forming operation, the first state transmitting the driving force of the driving means to the first supplying means, the second state transmitting the driving force of the driving means to the second supplying means, and control means for changing the time of the first state and the time of the second state during the aforementioned one image forming operation in conformity with an image to be formed.

Further objects of the present invention will become from the following description taken in conjunction with the accompanying drawings.

DESCRIPTION OF THE PREFERRED EMBODIMENTS

An image forming apparatus according to the present invention will hereinafter be described in greater detail with reference to the drawings.

Embodiment 1

The image forming apparatus of the present invention will hereinafter be described with respect to some embodiments thereof, but the constructions and action of a developing apparatus and a developer supplying apparatus used in the present embodiment are similar to those in the conventional example previously described in connection with FIGS. 16 and 17 and therefore, the previous description is invoked. Accordingly, in the following description, the driving construction and operation mode of the developer supplying apparatus which are the features of the present invention will be chiefly described in comparison with the conventional example.

General Construction and Operation of the Image Forming Apparatus

Figure 1:
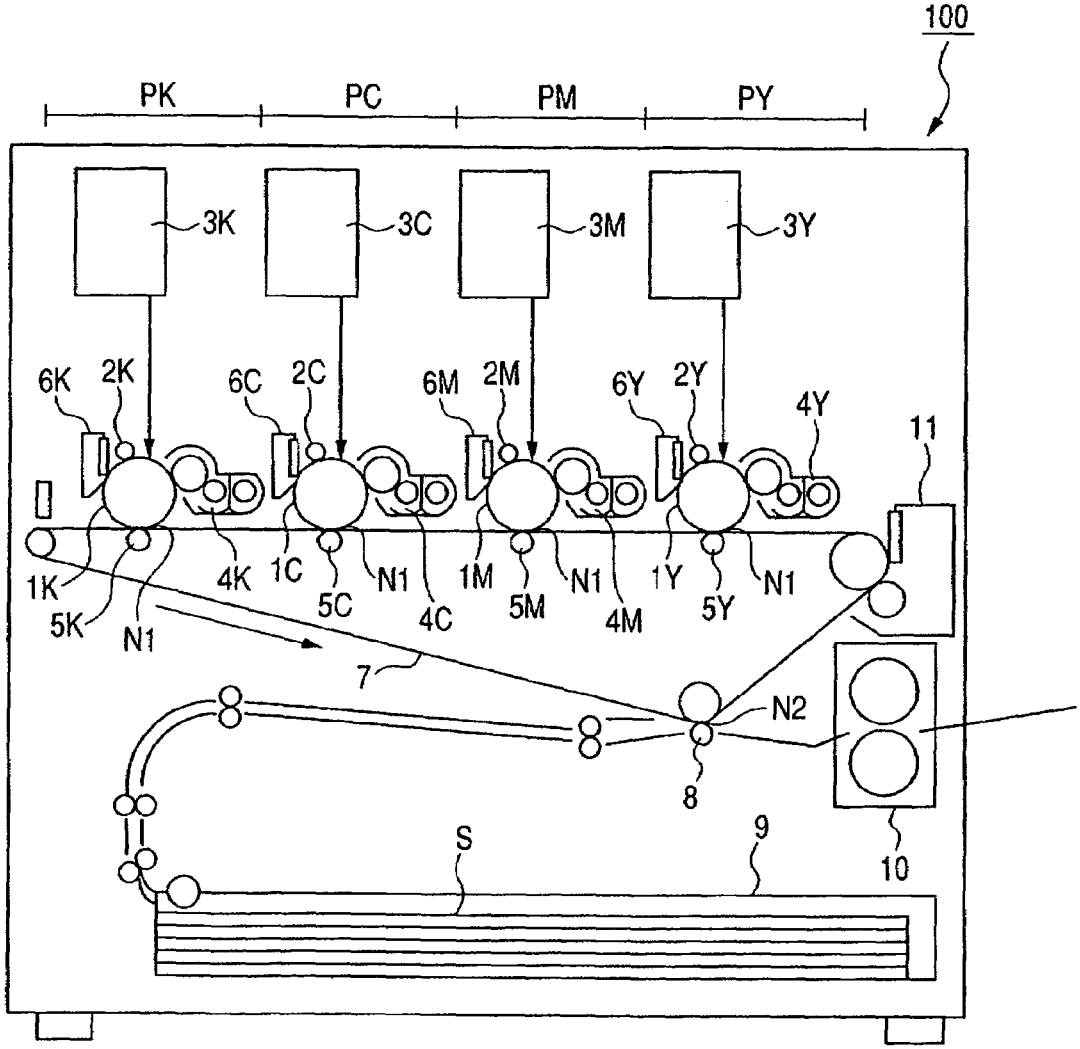
FIG. 1 schematically shows the construction of an embodiment of the image forming apparatus of the present invention.

Reference is first had to FIG. 1 to describe the general construction and operation of an embodiment of the image forming apparatus according to the present invention. The image forming apparatus according to the present embodiment is a color image forming apparatus of an electrophotographic type.

The image forming apparatus 100 according to the present embodiment can form a full-color image of four colors, i.e., yellow (Y), magenta (M), cyan (C) and black (K), on a recording material (such as recording paper, a plastic sheet or cloth) by the utilization of an electrophotographic printing method in accordance with image information from an original reading apparatus connected to an image forming apparatus main body (apparatus main body) or a host device such as a personal computer connected to the apparatus main body for communication.

The image forming apparatus 100 according to the present embodiment is an image forming apparatus of a four-set tandem type, and has first, second, third and fourth image forming stations P (PY, PM, PC, PK) as a plurality of image forming portions. Also, the image forming apparatus 100 according to the present embodiment adopts an intermediate transfer process. That is, during the time when an intermediate transfer belt 7 movable round (rotatable) as an intermediate transfer member is moved in the direction of arrow and passes through the respective image forming stations P, images of the respective colors are superposed on the intermediate transfer belt 7. Then, toner images of the colors superposed on this intermediate transfer belt 7 are transferred to the recording material S to thereby obtain a recorded image.

In the present embodiment, the constructions of the image forming stations P (PY, PM, PC, PK) are essentially the same with the exception that the developing colors differ from one another and therefore, unless distinction is not particularly required, description will be collectively made with the suffixes Y, M, C and K given to the reference character to indicate the colors they belong to omitted.

Each image forming station P has a drum-shaped electrophotographic sensitive member (hereinafter referred to as the "photosensitive drum") 1 as an image bearing member. Around the photosensitive drum 1, there are provided a charging roller 2 as charging means, an exposing apparatus (in the present embodiment, a laser exposing optical system) 3 as exposing means, a developing apparatus 4 as developing means, and a cleaning apparatus 6 as cleaning means. Also, a primary transfer roller 5 as primary transferring means is disposed so as to be opposed to the photosensitive drum 1 with the intermediate transfer belt 7 interposed therebetween.

During image formation, the charging roller 2 uniformly charges the photosensitive drum 1 being rotated. Then, the exposing apparatus 3 scans and exposes the surface of the charged photosensitive drum 1 in conformity with an image information signal. Thereby, an electrostatic image is formed on the photosensitive drum 1. The electrostatic image formed on the photosensitive drum 1 is developed as a toner image with a developer by the developing apparatus 4. Thereafter, the toner image formed on the photosensitive drum 1 is transferred onto the intermediate transfer belt 7 in a primary transferring portion (nip) N wherein the intermediate transfer belt 7 and the photosensitive drum 1 contact with each other.

Figure 18:
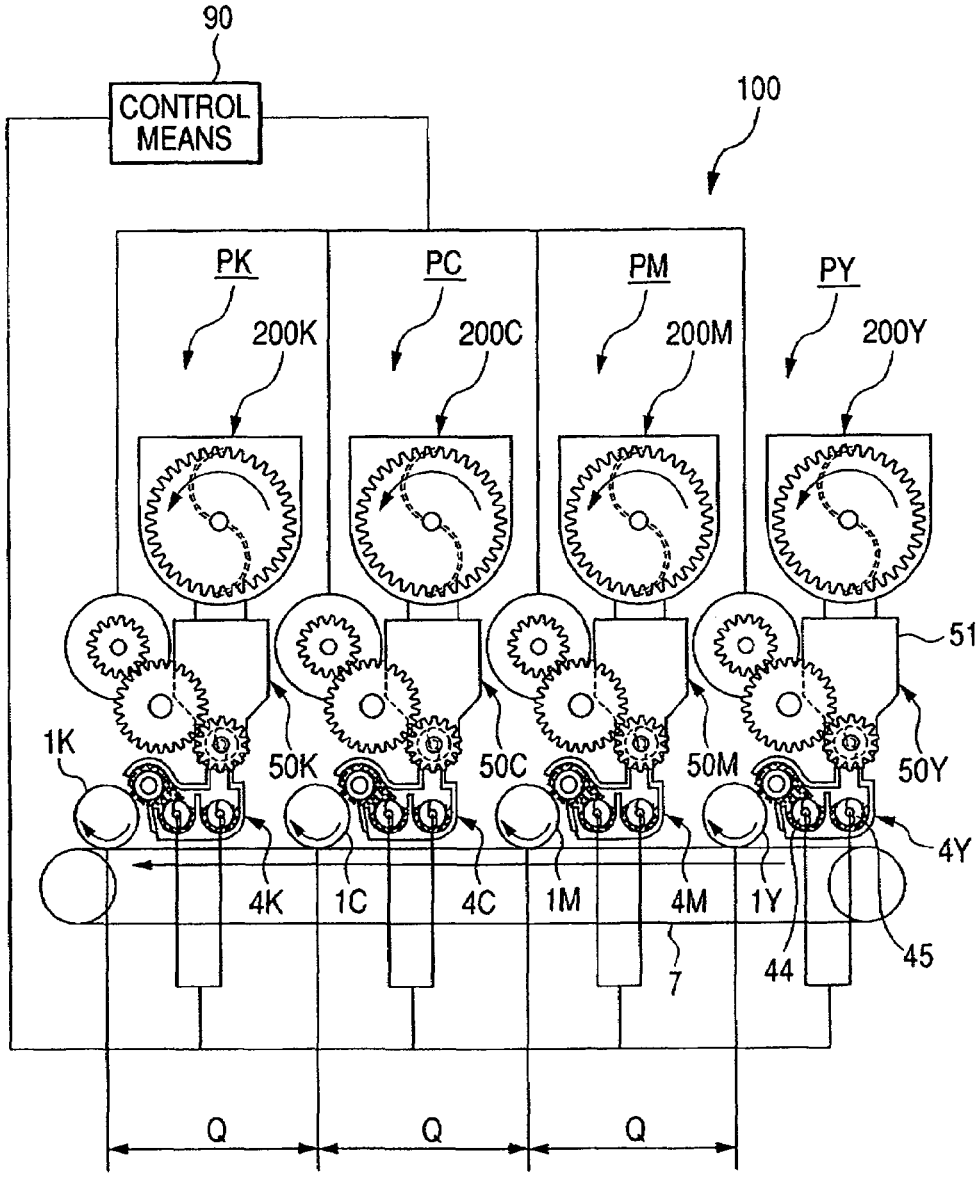
FIG. 18 schematically illustrates the construction of an image forming apparatus using the driving mechanism for the developer supplying apparatus and the developing apparatus shown in FIG. 17.

For example, during the formation of a four-color full-color image, an image forming operation is performed in the respective image forming stations in succession from the first image forming station PY with a delay of a time for which the intermediate transfer belt 7 is moved by the distance Q (see FIG. 18) between adjacent ones of the photosensitive drums 1. Thereby, with the movement of the intermediate transfer belt 7, the toner images of the respective colors are successively transferred to the intermediate transfer belt 7 in the primary transferring portions N1 of the respective image forming stations P, and a multiplex toner image comprising the toner images of four colors superposed one upon another is formed on the intermediate transfer belt 7.

On the other hand, the recording material S contained, for example, in a cassette 9 as a recording material containing portion is conveyed to a secondary transferring portion (nip portion) N2 in which the intermediate transfer belt 7 and a secondary transfer roller 8 as secondary transferring means contact with each other in synchronism with the toner image on the intermediate transfer belt 7 by recording material conveying members such as a pickup roller, conveying rollers and registration rollers.

Thus, the multiplex toner image on the intermediate transfer belt 7 is transferred onto the recording material S in the secondary transferring portion N2. Thereafter, the recording material S is separated from the intermediate transfer belt 7 and is conveyed to a fixing device 10. The recording material S is heated and pressurized by the fixing device 10, whereby the unfixed toner image on the recording material S is fixed. Thereafter, the recording material S is discharged out of the machine.

After the primary transferring step, adhering substances such as the toners residual on the photosensitive drum 1 are removed by the cleaning apparatus 6. Also, after the secondary transferring step, adhering substances such as the toners residual on the intermediate transfer belt 7 are removed by an intermediate transfer member cleaner 11.

It is also possible to form an image of a single color or multiple colors by the use of an image forming portion for a single color such as black or image forming portions for some of the four colors.

Also, in the present embodiment, the image forming apparatus 100 is described as adopting the intermediate transfer process, but the present invention is not restricted thereto. As is well known to those skilled in the art, there is an image forming apparatus provided with a recording material bearing member for bearing the recording material thereon and conveying it to the nip portion with each photosensitive drum 1, instead of the above-described intermediate transfer member 7. In this case, toner images of the respective colors are multiplexly transferred to the recording material on the recording material bearing member, whereafter this multiplex toner image is fixed to thereby obtain a recorded image. The present invention is equally applicable to such an image forming apparatus.

Figure 2:
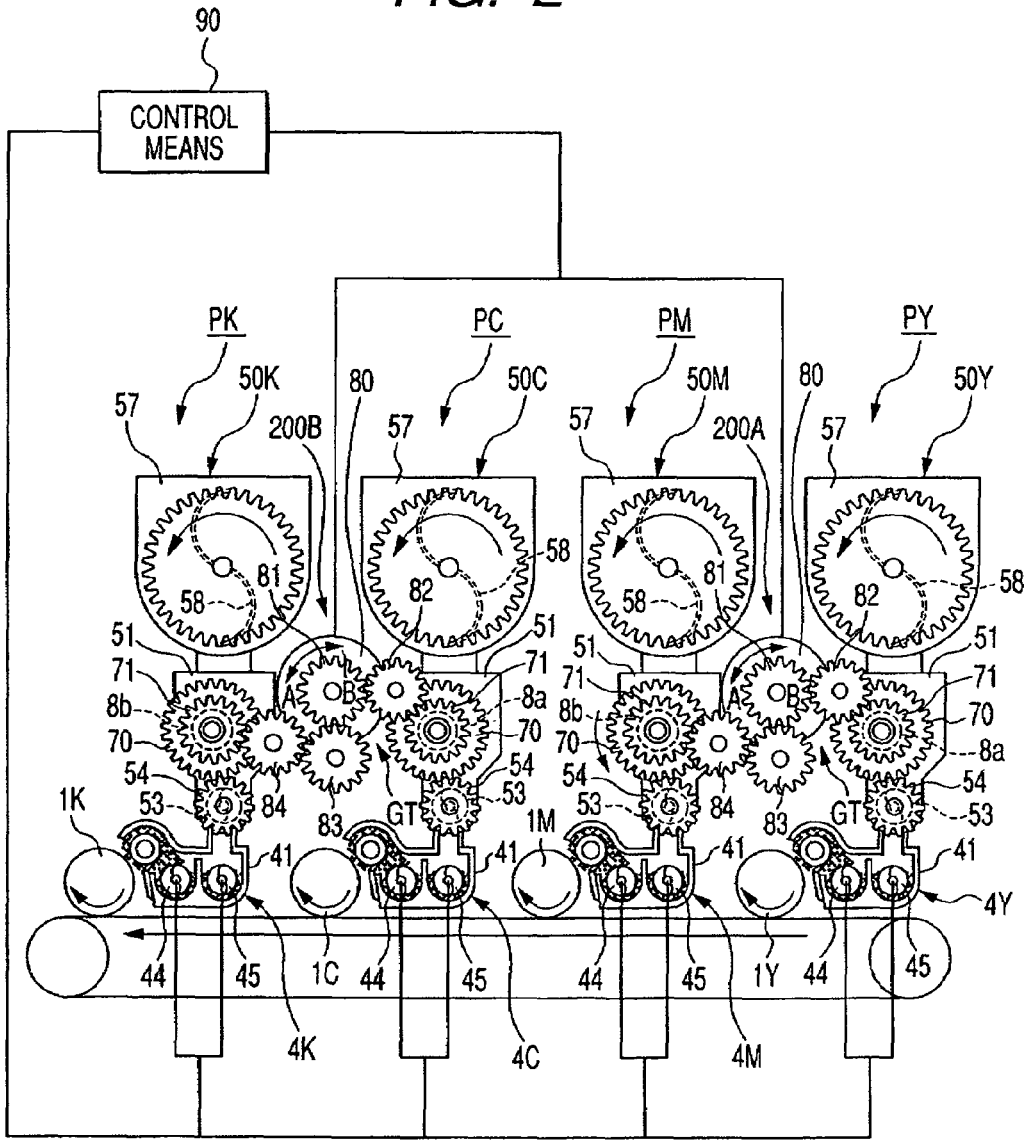
FIG. 2 schematically illustrates the construction of an image forming apparatus according to an embodiment of the present invention using a driving mechanism for a developer supplying apparatus and a developing apparatus.

Driving Constructions and Operations of the Developing Apparatus and the Developer Supplying Apparatus Reference is now had to FIG. 2 to describe the driving constructions of the developing apparatus 4 and a developer supplying apparatus 50.

In the present embodiment, as described above, the constructions of the image forming stations P (PY, PM, PC, PK) are substantially the same with the exception that the developing colors differ from one another, and the developing apparatuses 4 (4Y, 4M, 4C, 4K) and the developer supplying apparatuses 50 (50Y, 50M, 50C, 50K) are also similar in construction.

Also, as described above, the constructions and action of the developing apparatus 4 and the developer supplying apparatus 50 used in the present embodiment are similar to those in the conventional example previously described in connection with FIG. 16 and therefore, the previous description is invoked, but the constructions and action of the developing apparatus 4 and the developer supplying apparatus 50 will be briefly described as follows.

Figure 16B:
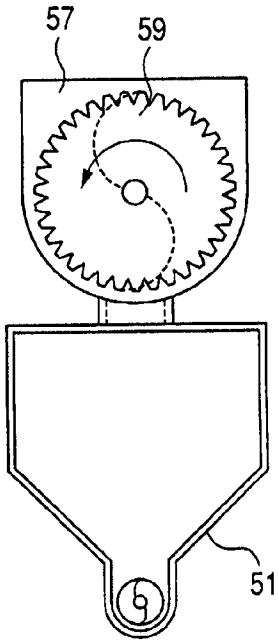
FIG. 16B schematically shows the constructions of the developing apparatus and developer supplying apparatus of FIG. 16A from a drive gear side.
Figure 16A:
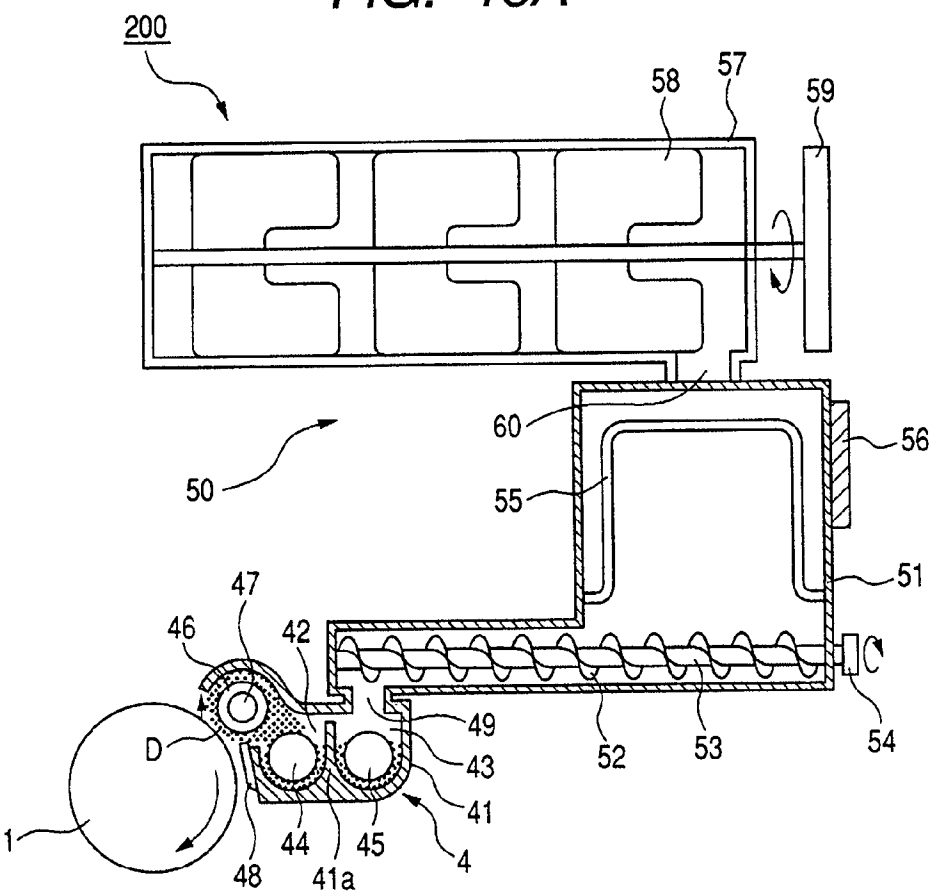
FIG. 16A schematically shows the constructions of a developing apparatus and a developer supplying apparatus.
Figure 17:
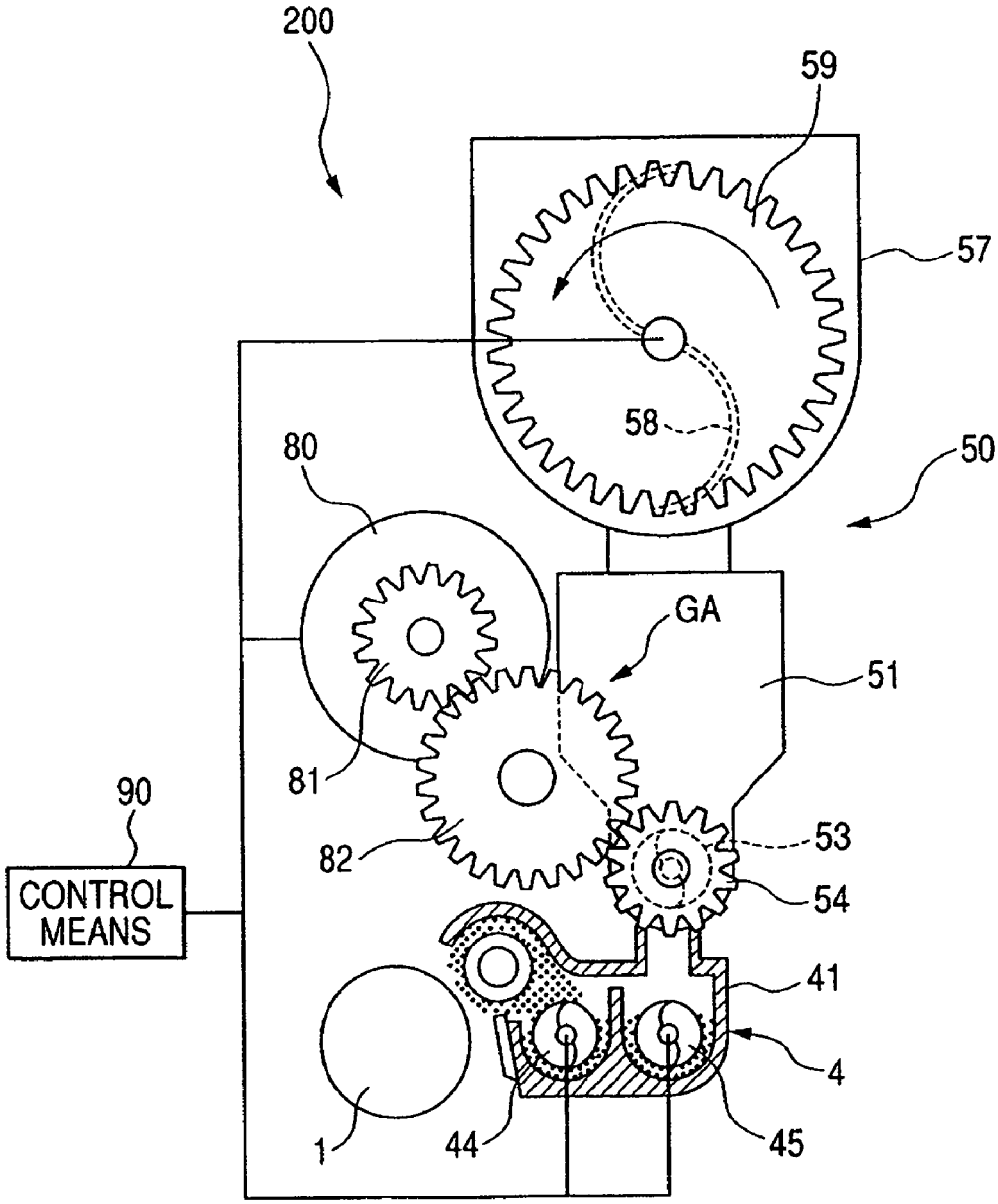
FIG. 17 illustrates the construction of a driving mechanism for a developer supplying apparatus and a developing apparatus according to the prior art.

As will be understood if reference is had to FIG. 16 and also the description made in connection therewith, the developing apparatus 4 can develop the electrostatic image on the photosensitive drum 1 into a visible image by the use of the developer stored therein.

That is, the developing apparatus 4 has a developing screw 44 and an agitating screw 45 which are developer agitating means for agitating and carrying the developer in the developing apparatus 4. Also, the developer supplying apparatus 50, as described above, has a sub-toner container 51 as a first developer container containing therein the developer (toner) to be supplied to the developing apparatus 4, a supply screw 53 as first supplying means for discharging the toner from the sub-toner container 51 and supplying it to the developing apparatus 4, a main toner container 57 as a second developer container storing therein the toner to be supplied to the sub-toner container 51, and an agitating and carrying member 58 as second supplying means for discharging the toner from the main toner container 57 and supplying it to the sub-toner container 51.

According to the present embodiment, the developer supplying apparatuses 50Y and 50M of the yellow developing apparatus (first developing apparatus) 4Y and the magenta developing apparatus (second developing apparatus) 4M, respectively, provided in the yellow image forming station PY and the magenta image forming station PM located downstream of the yellow image forming station PY with respect to an image forming direction, respectively, are driven by a first driving mechanism 200A. Also, likewise, the developer supplying apparatuses 50C and 50K of the cyan developing apparatus (first developing apparatus) 4C and the black developing apparatus (second developing apparatus) 4K, respectively, provided in the cyan image forming station PC and the black image forming station PK located downstream of the cyan image forming station PC with respect to the image forming direction, respectively, are driven by a second driving mechanism 200B. The first driving mechanism 200A and the second driving mechanism 200B are similar in construction and function to each other and accordingly, the first driving mechanism 200A will hereinafter be described.

The driving mechanism 200A for the developer supplying apparatus 50 has a motor 80 which is rotatively driving means capable of transmitting a drive to the supply screw 53, and a drive gear train GT as rotation transmitting means capable of transmitting the rotation of the motor 8 to the supply screw 53.

The agitating and carrying member 58, as in the prior art, can also transmit the drive from the motor 80 to a drive gear 59 through a drive gear train (not shown), but can also be driven by the use of a motor discrete from the motor 80.

Further describing, the drive gear train GT for transmitting the drive to the supplying screw 53 has a first drive gear 81 on the motor 80 side, and second and third drive gears 82 and 83 meshing with the first drive gear 81. The second drive gear 81 meshes with a first screw gear 71 on the first developing apparatus 4Y side to transmit a drive to the supply screw 53 side of the first developing apparatus (i.e., the yellow developing apparatus) 4Y. Also, the third drive gear 83 meshes with the first screw gear 71 on the second developing apparatus 4M side through a fourth drive gear 84 to transmit a drive to the supply screw 53 side of the second developing apparatus (i.e., the magenta developing apparatus) 4M.

In the first and second developing apparatuses 4Y and 4M, the first screw gear 71 meshes with a second screw gear 70 through one-way clutches 8*a* and 8*b*, and the second screw gear 70 meshes with a screw driving gear 54 for driving the supply screw 53.

According to the present embodiment, as will be described later in detail, the drive gear train GT functions as changeover means capable of changing over the rotation of the motor 80 to a first state in which it can be transmitted to the supply screw 53 of the first developing apparatus 4Y and a second state in which it can be transmitted to the supply screw 53 of the second developing apparatus 4M.

Control means 90 controls the forward and reverse rotations and stoppage of the motor 80. The control means 90 also controls the rotation and stoppage of the developer agitating means, i.e., the developing screw 44 and the carrying screw 45, of the developing apparatus 4.

Also, the one-way clutches 8*a* and 8*b* are designed to transmit the rotation in a direction indicated, but not to transmit the rotation in the opposite direction. Accordingly, when the motor 80 is rotated in the direction of arrow A, the one-way clutch 8*a* transmits the drive and the one-way clutch 8*b* idly rotates, and when conversely the motor 80 is rotated in the direction of arrow B, the one-way clutch 8*b* transmits the drive and the one-way clutch 8*a* idly rotates.

As the result, when the motor 80 is rotated in the direction of arrow A, the supply screw 53 of the first developing apparatus 4Y side is rotated with the supplying screw 53 of the second developing apparatus 4M side remaining stopped, and when the motor 80 is rotated in the direction of arrow B, the supply screw 53 of the second developing apparatus 4M side is rotated with the supply screw 53 of the first developing apparatus 4Y side remaining stopped.

As described above, the drive gear train GT includes the one-way clutches 8*a* and 8*b* and therefore, the control means 90 changes over the rotation direction of the motor 80, whereby the drive gear train GT can act as changeover means capable of changing over the rotation of the motor 80 into two states, i.e., the first state in which it can be transmitted to the supplying screw 53 of the first developing apparatus 4Y side, and the second state in which it can be transmitted to the supply screw 53 of the second developing apparatus 4M side. That is, the changeover means can change over the two states during the operation of forming one image to use the driving force of the motor 80 in at least two states, i.e., the first state in which it can be transmitted to the supply screw 53 of the first developing apparatus 4Y side, and the second state in which it can be transmitted to the supply screw 53 of the second developing apparatus 4M side. Also, the control means 90 can act on the changeover means to thereby change the time of the first state and the time of the second state during the operation of forming one image, in conformity with the image to be formed. For example, the control means 90 can change the time of the first state and the time of the second state, in conformity with the density of the image to be developed by the first developing apparatus 4Y and the density of the image to be developed by the second developing apparatus 4M.

When by the construction as described above, the supply screw 53 of the first developing apparatus 4Y side is to be rotated to thereby supply the toner from the sub-toner container 51 to the developing apparatus 4Y, if the motor 80 is rotated in the direction of arrow A, it is possible to rotate the supply screw 53 of the first developing apparatus 4Y side with the supply screw 53 of the second developing apparatus 4M side remaining stopped. Also, when the supply screw 53 of the second developing apparatus 4M side is to be rotated to thereby supply the toner from the sub-toner container 51 to the second developing apparatus 4M, if the motor 80 is rotated in the direction of arrow B, it is possible to rotate the supply screw 53 of the second developing apparatus 4M side with the supply screw 53 of the first developing apparatus 4Y side remaining stopped. Accordingly, as compared with the conventional example, one motor can be curtailed and therefore, the simplification, downsizing and lower cost of the image forming apparatus can be realized.

Also, the timing at which the supply screw 53 starts its rotation and is stopped is restricted to the time when the agitating means of the developing apparatus is rotated, as in the conventional example.

Figure 3:
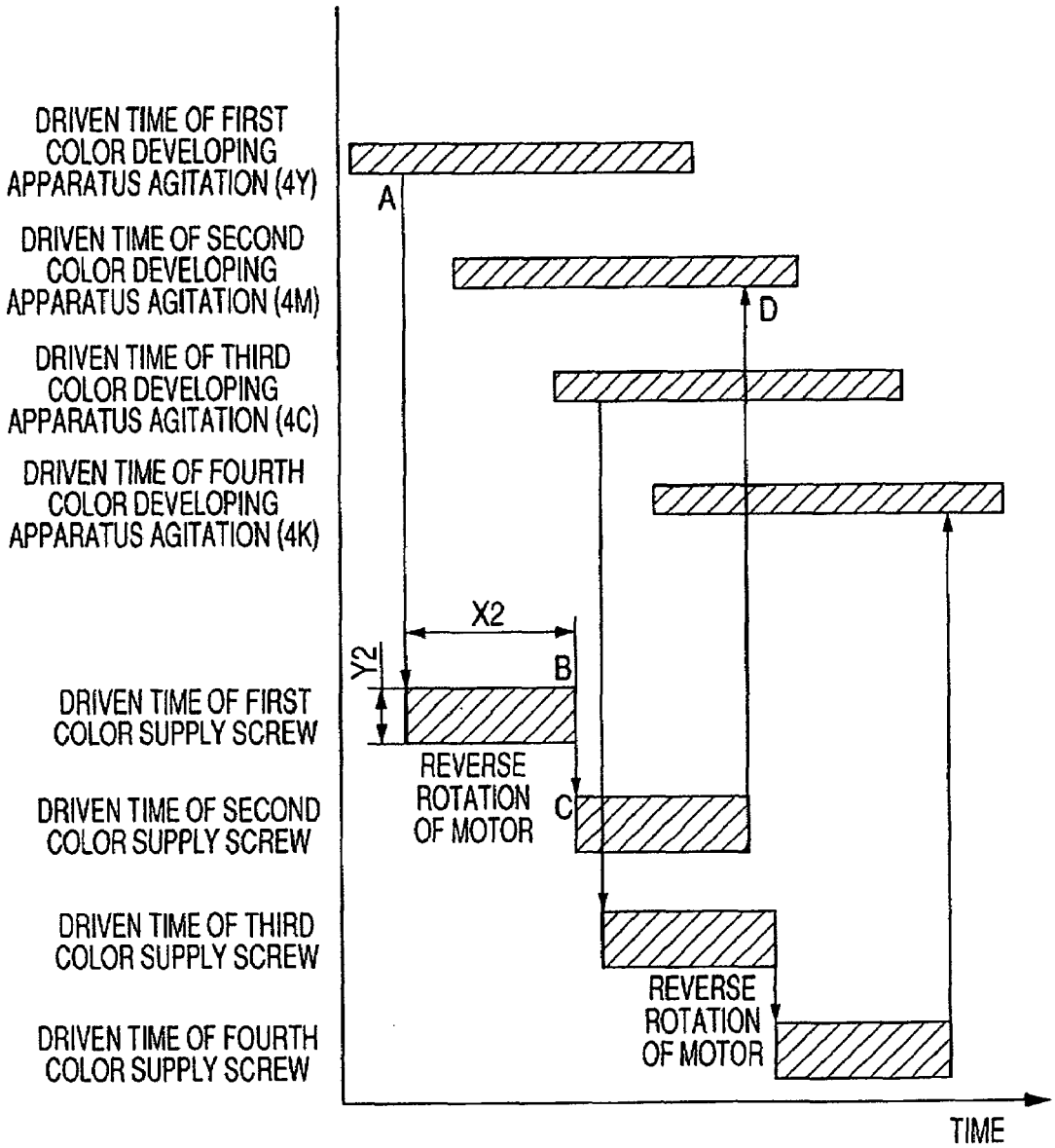
FIG. 3 illustrates the timing of the rotation and stoppage of the developer agitating means (agitating screw and developing screw) of a developing apparatus and the supplying screw of a developer supplying apparatus in an embodiment of the present invention.

FIG. 3 shows the timing in the present embodiment, and the control means 90 is set so that after the agitating means 44 and 45 of the first developing apparatus 4Y have started their rotation, the rotation of the supply screw 53 may be started (A in FIG. 3), and after the rotation of the supply screw 53 of the first developing apparatus 4Y side has been stopped, the agitating means 44 and 45 of the first developing apparatus 4Y may be stopped (B in FIG. 3), and after the agitating means 44 and 45 of the second developing apparatus 4M have started their rotation, the rotation of the supply screw 53 of the second developing apparatus 4M side may be started (C in FIG. 3), and after the rotation of the supply screw 53 of the second developing apparatus 4M side has been stopped, the agitating means 44 and 45 of the second developing apparatus 4M may be stopped (D in FIG. 3).

Figure 19:
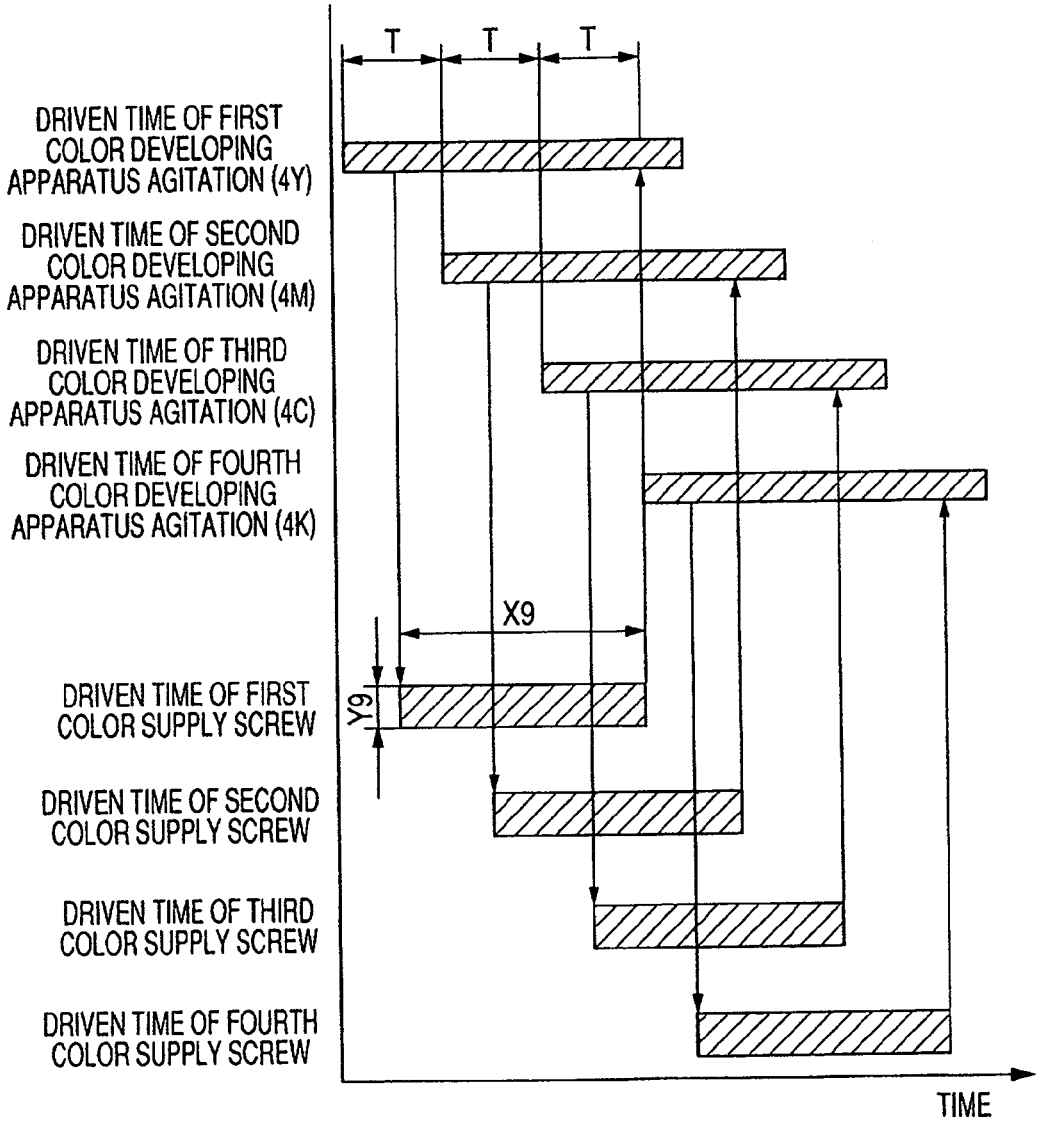
FIG. 19 illustrates the timing of the rotation and stoppage of the developer agitating means (agitating screw and developing screw) of the developing apparatus and the supply screw of the developer supplying apparatus.

When FIGS. 3 and 19 are compared with each other, it is apparent that the time for which the toner is supplied per developing apparatus is shorter in the present embodiment as can be seen from the comparison between X9 in FIG. 19 and X2 in FIG. 3.

Of course, this is because heretofore, a motor has been provided for each developing apparatus, whereas in the present embodiment, only one motor is provided for two developing apparatuses.

However, even when the supplying time is short as described above, if the toner when printing of the highest density is effected in a maximum print range cannot be supplied to the developing apparatus within a predetermined time, the T/C in the developing apparatus cannot be kept constant.

Each of X2 and X9 indicated in FIGS. 3 and 19, respectively, is indicative of the amount of toner supply per unit time, and in FIG. 3, Y2 has increased relative to Y9 in inverse proportion to the rate at which X2 has become short relative to X9, and the product of X2 and Y2 indicative of an amount of suppliable toner and the product of X9 and Y9 (the area of hatched portions) are equal to each other in FIGS. 3 and 19.

Thus, in the present embodiment, the amount of supply per unit is increased, whereby the same amount of toner as in the conventional example becomes suppliable within a predetermined time.

However, an increase in the amount of toner supply per unit time generally leads to not a little evil that supply accuracy lowers and the supply of the toner concentrates in a portion and therefore it is difficult for the T/C ratio in the developing apparatus to become uniform and thus, it is desirable that the amount of toner supply per unit time be as small as possible.

The amount of toner supply indicated by the aforementioned hatched portions is indicative of a maximum amount of supply when printing of the highest density is effected in a maximum print range, and it is usual that the amount of toner of a practical image actually used is 20% or less of the maximum density and therefore, in almost all cases, it is not necessary to supply the toner at such a maximum speed as shown in FIG. 3.

Thus, the capability of the apparatus is set such that the supply speed can follow a maximum amount of used toner, but for example, when printing of low density is to be effected, it is desirable to effect the control of reducing the amount of toner supply per unit time in order to suppress such evils as the lowering of supply accuracy and the non-uniformity of the T/C ratio in the developing apparatus as far as possible. That is, in the present embodiment, preferably, supply amount controlling means capable of controlling an increase or decrease in the amount of toner supply by the supply screw.

Description will hereinafter be made about to what degree the amount of supply can be reduced in a case where it becomes possible to reduce the amount of toner supply per unit time and respective cases.

Figure 4:
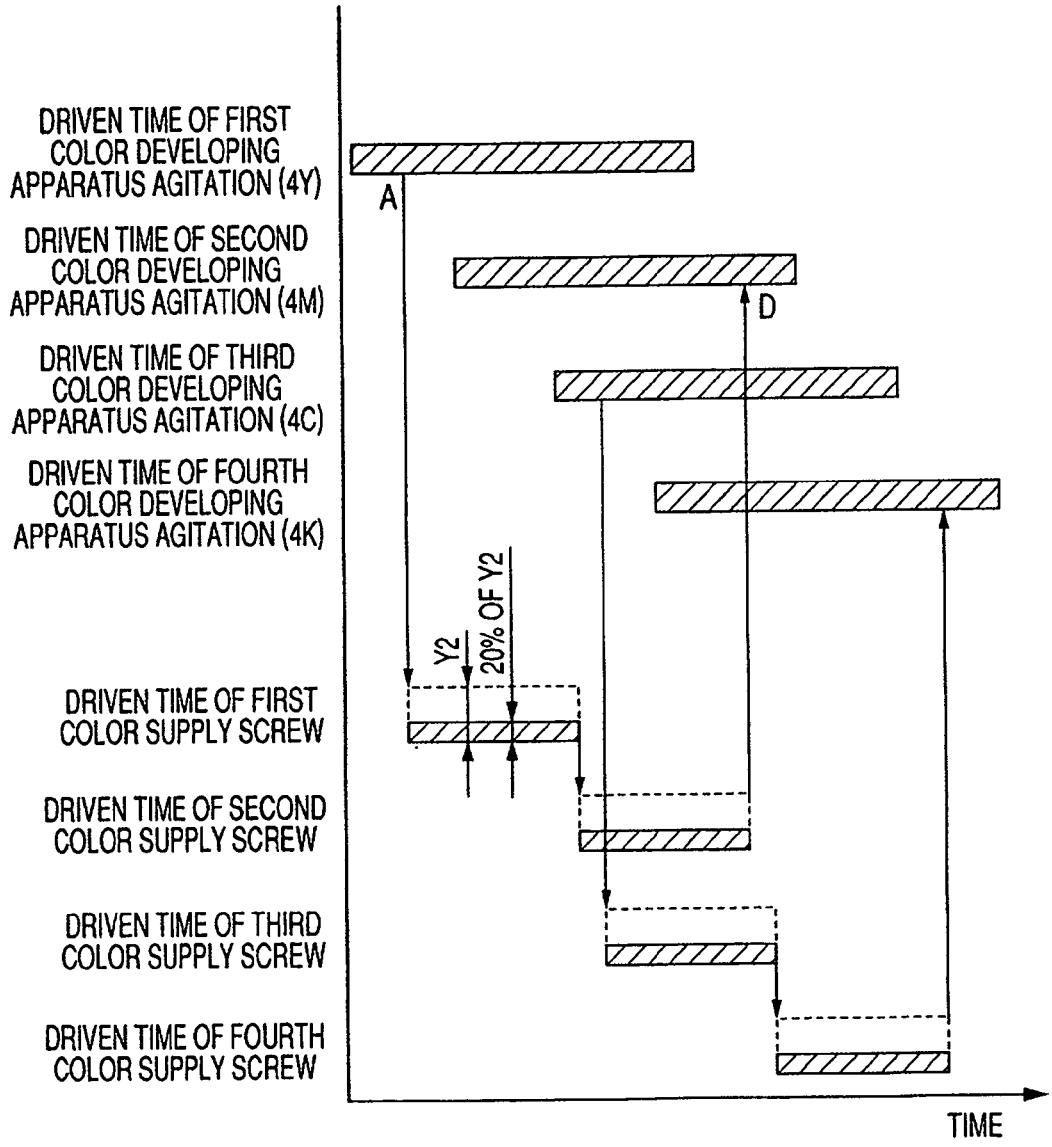
FIG. 4 illustrates the timing of the rotation and stoppage of the developer agitating means (agitating screw and developing screw) of a developing apparatus and the supply screw of a developer supplying apparatus in another embodiment of the present invention.

A first case where the amount of toner supply per unit time can be reduced is a case where the density of an image to be printed, i.e., developed image density is low. FIG. 4 shows an example of that case, and for example, in a case where printing of density of 20% of maximum density is only effected, the amount of toner to be supplied may be 20% and therefore, as shown, the amount of supply per unit time is controlled at 20% of the amount of toner supply shown in FIG. 3. That is, the supply amount controlling means, when it controls the amount of supply per unit time by the supply screw of the first or second developing apparatus, controls with a tendency to increase the amount of supply if the developed image density by the pertinent developing apparatus is high, and to decrease the amount of supply if the developed image density is low.

Figure 5:
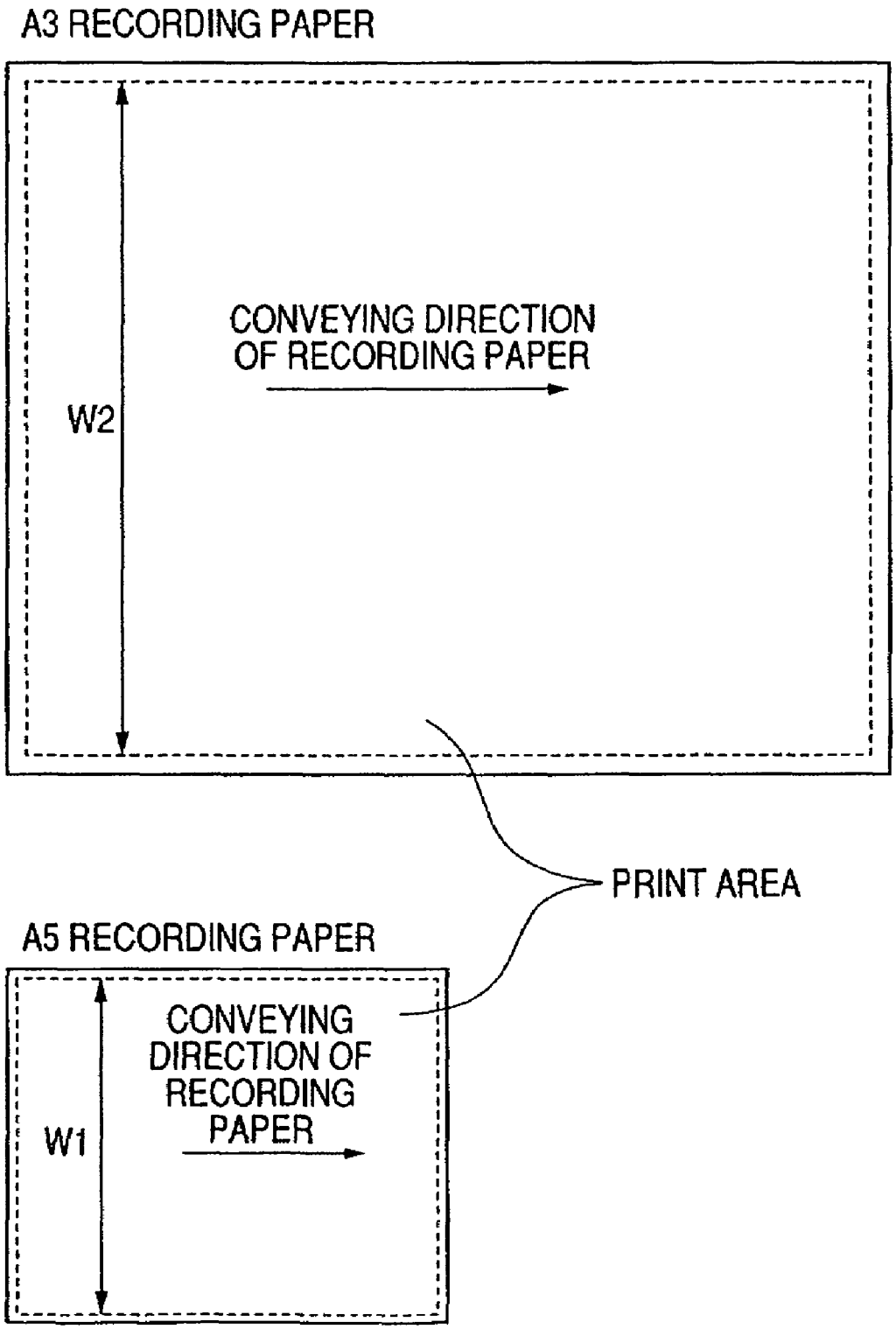
FIG. 5 is a view for illustrating the difference between the width and the maximum print range of recording paper.

A second case where the amount of toner supply per unit time can be reduced is a case where the width of a recording material, i.e., paper for recording (recording paper) is narrow even if an image to be printed is of the highest density in a maximum print range. Even if as shown in FIG. 5, the width of the paper for recording is narrow, even if printing of the highest density in the maximum print range is effected, the amount of used toner may be small at a rate of W1/W2, shown. The supply amount controlling means, when it controls the amount of supply per unit time by the supply screw of the first or second developing apparatus, controls with a tendency to increase the amount of supply if the length of recording paper to which the visible image on the photosensitive drum is transferred in a main scanning direction is great, and to decrease the amount of supply if the length of the recording paper in the main scanning direction is small.

Figure 6:
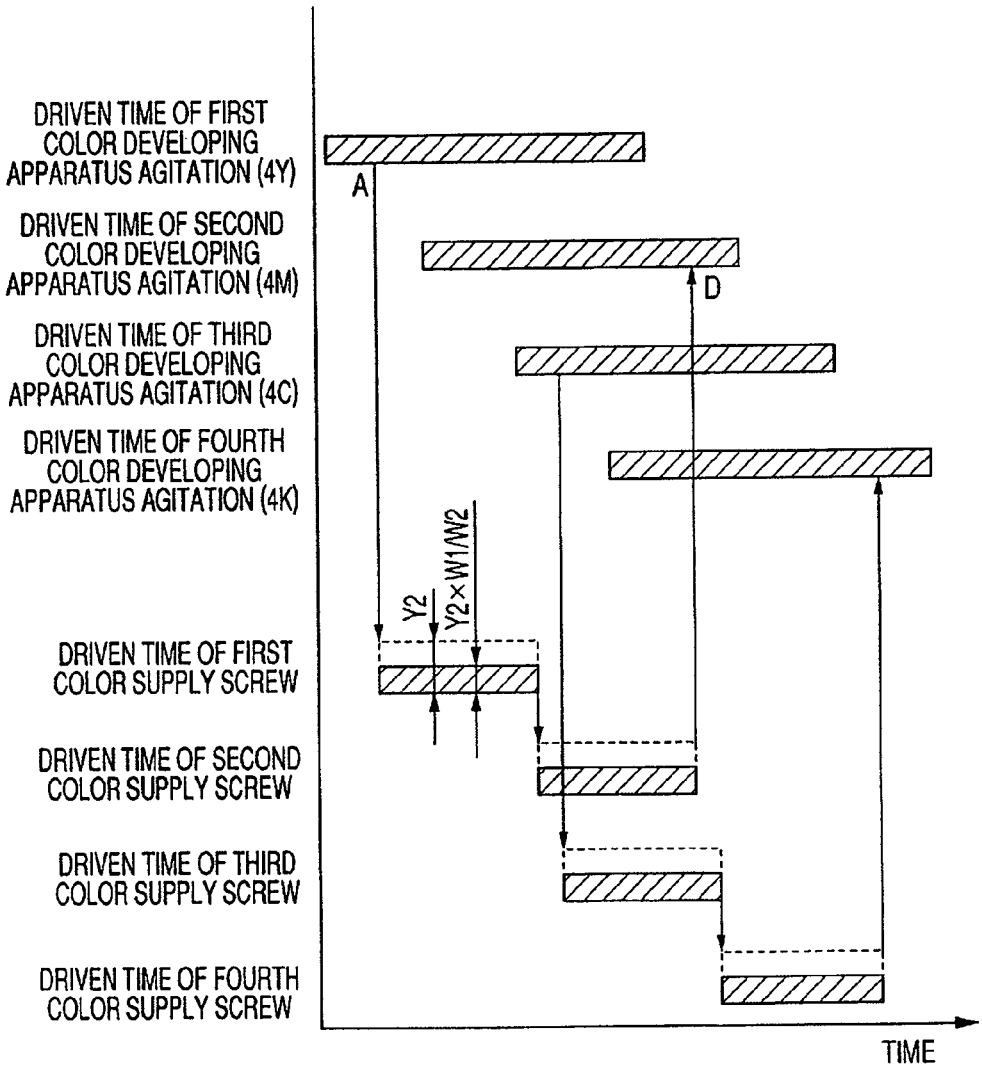
FIG. 6 illustrates the timing of the rotation and stoppage of the developer agitating means (agitating screw and developing screw) of a developing apparatus and the supply screw of a developer supplying apparatus in another embodiment of the present invention.

FIG. 6 shows the controlling method at that time, and the amount of supply per unit time is controlled at (W1/W2) times as great as the amount of supply shown in FIG. 3. If density is low at this time, of course, the amount of supply per unit time can be reduced.

A third case where the amount of toner supply per unit time can be reduced is a case where the recording speed is reduced even if the image to be printed is of the highest density in the maximum print range and the width of the paper for recording is maximum.

There has been proposed the control of printing with the printing speed reduced to the order of ½ in order to secure the fixing property of the toner in a case where recording is effected on very thick recording paper, or a case where printing is effected on recording paper having a rough surface.

Figure 7:
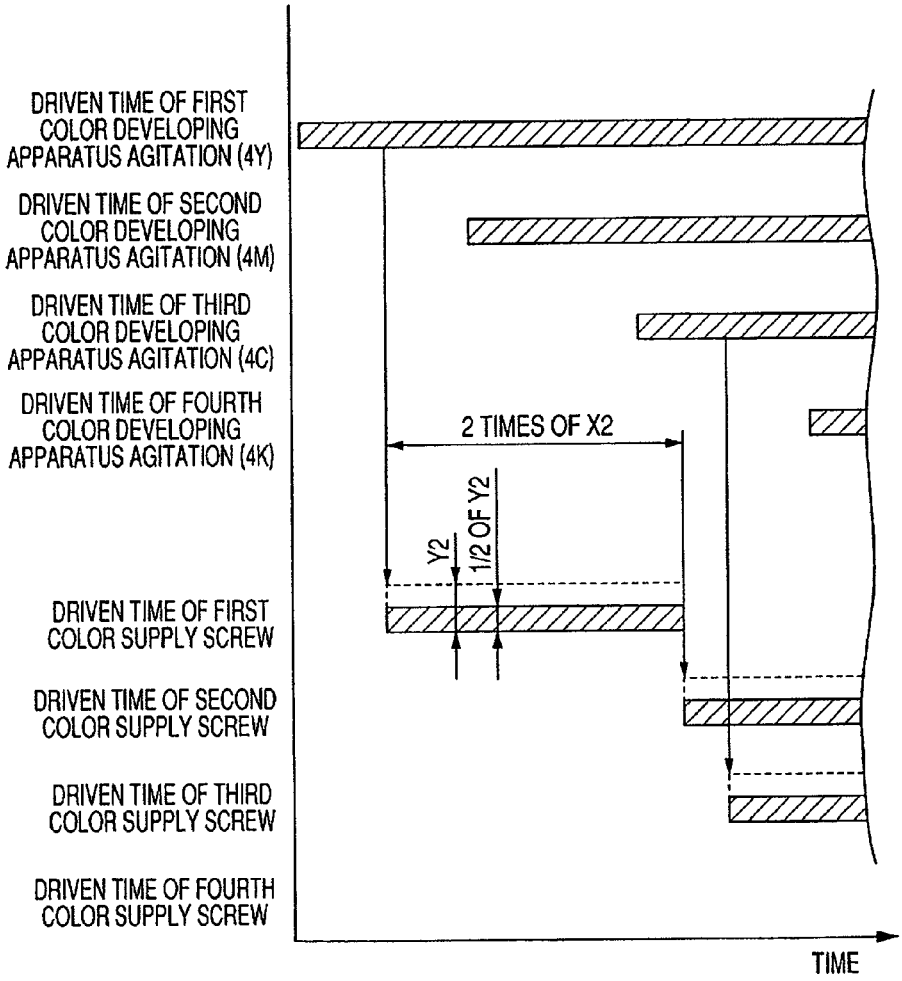
FIG. 7 illustrates the timing of the rotation and stoppage of the developer agitating means (agitating screw and developing screw) of a developing apparatus and the supply screw of a developer supplying apparatus in another embodiment of the present invention.

FIG. 7 shows an example of that case, and shows, for example, a case where the printing speed has been reduced to ½. In this case, the time for which the toner should be supplied is twice as long, as shown, and therefore, even if the amount of supply per unit time is reduced to ½, supply equal to the maximum amount of supply can be done. That is, the supply amount controlling means, when it controls the amount of supply per unit time by the supply screw of the first or second developing apparatus, controls with a tendency to increase the amount of supply if the image forming speed is high, and to decrease the amount of supply if the image forming speed is low.

If at this time, density is low, the amount of supply per unit time can be of course further reduced, and if the width of the paper for recording is narrow, the amount of supply per unit time can of course be further reduced.

A fourth case where the amount of toner supply per unit time can be reduced is a case where the density (print rate) of each color is partial. The print rate referred to here means the rate of the number of actually formed pixels occupying the total number of pixels of an image area to be formed.

Mentioning an extreme example, in a case where for example, the density of a first color is 5%, the density of a second color is 70%, the density of a third color is 50%, and the density of a fourth color is 2%, the supply time of the first color and the fourth color can be made short and therefore, it is possible to give much time to the supply of the second color and the third color.

Figure 8:
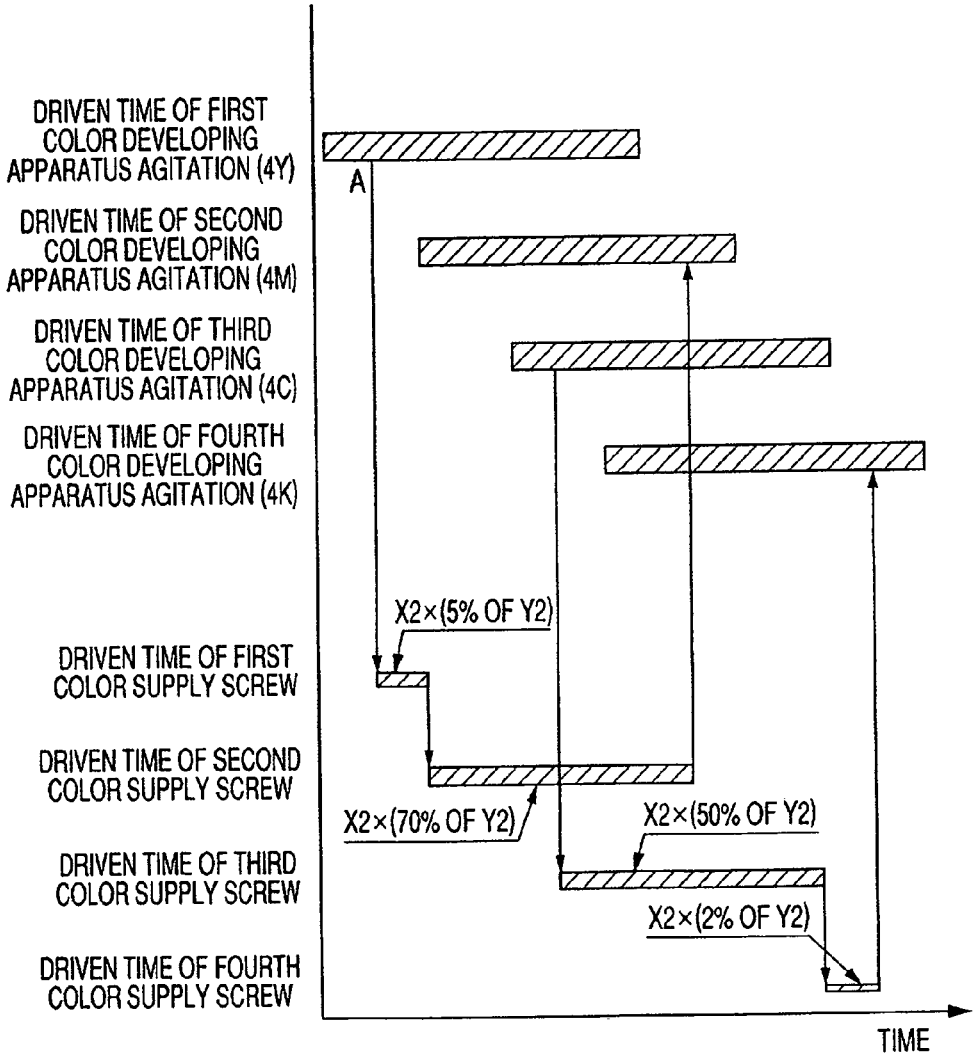
FIG. 8 illustrates the timing of the rotation and stoppage of the developer agitating means (agitating screw and developing screw) of a developing apparatus and the supply screw of a developer supplying apparatus in another embodiment of the present invention.

FIG. 8 shows an example of that case, and it is possible to allot a supply time by a constant algorithm from the density of each color to thereby control.

That is, the supply amount controlling means, when it controls the amount of supply per unit time by the supply screw of the first or second developing apparatus, controls with a tendency.

(1) to decrease the amount of supply if the developed image density by the second developing apparatus is high, in the case of the supply screw of the first developing apparatus, and decrease the amount of supply if the developed image density by the first developing apparatus is high, in the case of the supply screw of the second developing apparatus, and (2) to increase the amount of supply if the developed image density by the second developing apparatus is low, in the case of the supply screw of the first developing apparatus, and increase the amount of supply if the developed image density by the first developing apparatus is low, in the case of the supply screw of the second developing apparatus.

In such cases as described above, the control of reducing the amount of supply per unit time is possible, and by such a theory as described above, the control of reducing the amount of supply per unit time by a constant algorithm from the density, recording width and printing speed of each color, the density of adjacent colors sharing the drive source, etc. is possible.

Figure 9:
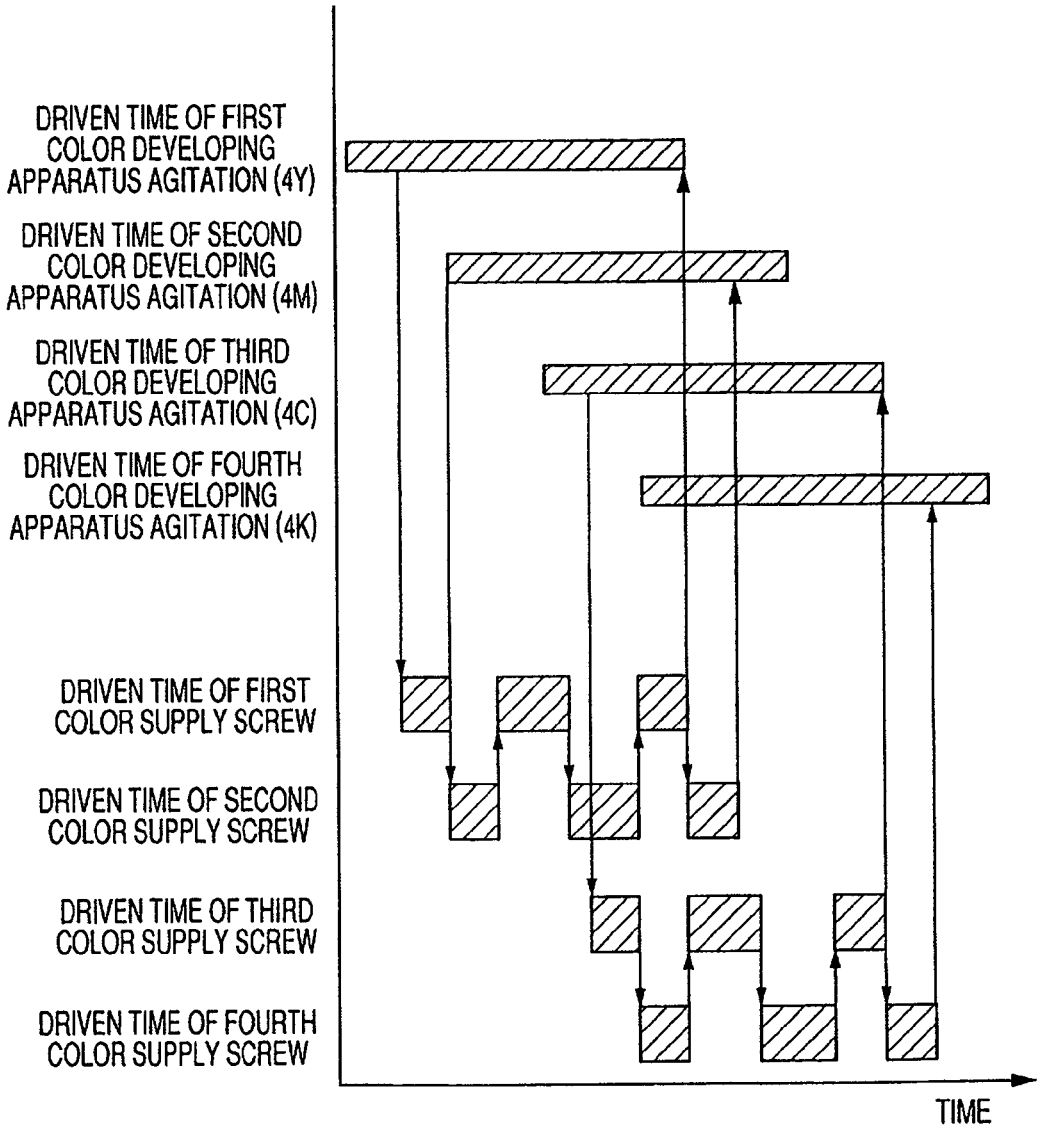
FIG. 9 illustrates the timing of the rotation and stoppage of the developer agitating means (agitating screw and developing screw) of a developing apparatus and the supply screw of a developer supplying apparatus in another embodiment of the present invention.

Also, for example, it is also possible not only to divide a suppliable range into a first half and a second half, but also to divide it into several times as shown in FIG. 9 to thereby change over, and in this case, the control becomes somewhat complicated and the changeover time is accumulated several times and therefore, the total supply time becomes short, but the evil that it is difficult for the T/C ratio in the developing apparatus to become uniform is improved greatly.

In the present embodiment, as shown in FIGS. 1 and 2, the image forming apparatus is an image forming apparatus in which developing apparatuses for four colors are provided side by side, and the above-described construction and operation mode to the yellow developing apparatus 4Y and the magenta developing apparatus 4M can also be applied to the cyan developing apparatus 4C and the black developing apparatus 4K adjacent thereto to thereby achieve a similar operational effect.

According to the present invention, however, the image forming apparatus is not restricted to an image forming apparatus in which developing apparatuses for four colors are provided side by side, but if there are two or more developing apparatuses, a similar effect can be obtained, and of course, it is also possible to apply the present embodiment to only two of the four colors, and adopt the conventional construction in the other developing apparatuses.

Embodiment 2

Description will now be made of a second embodiment of the image forming apparatus of the present invention. Again in this embodiment, the image forming apparatus, the developing apparatuses and the developer supplying apparatuses are similar in construction to the image forming apparatus, the developing apparatuses and the developer supplying apparatuses described in Embodiment 1. Accordingly, the description of Embodiment 1 is invoked for the detailed description of the general constructions of the image forming apparatus, the developing apparatuses and the developer supplying apparatuses, and the description thereof need not be made again, and the driving constructions and operations of the developing apparatuses and the developer supplying apparatuses which form the features of the present embodiment will hereinafter be described.

Figure 10:
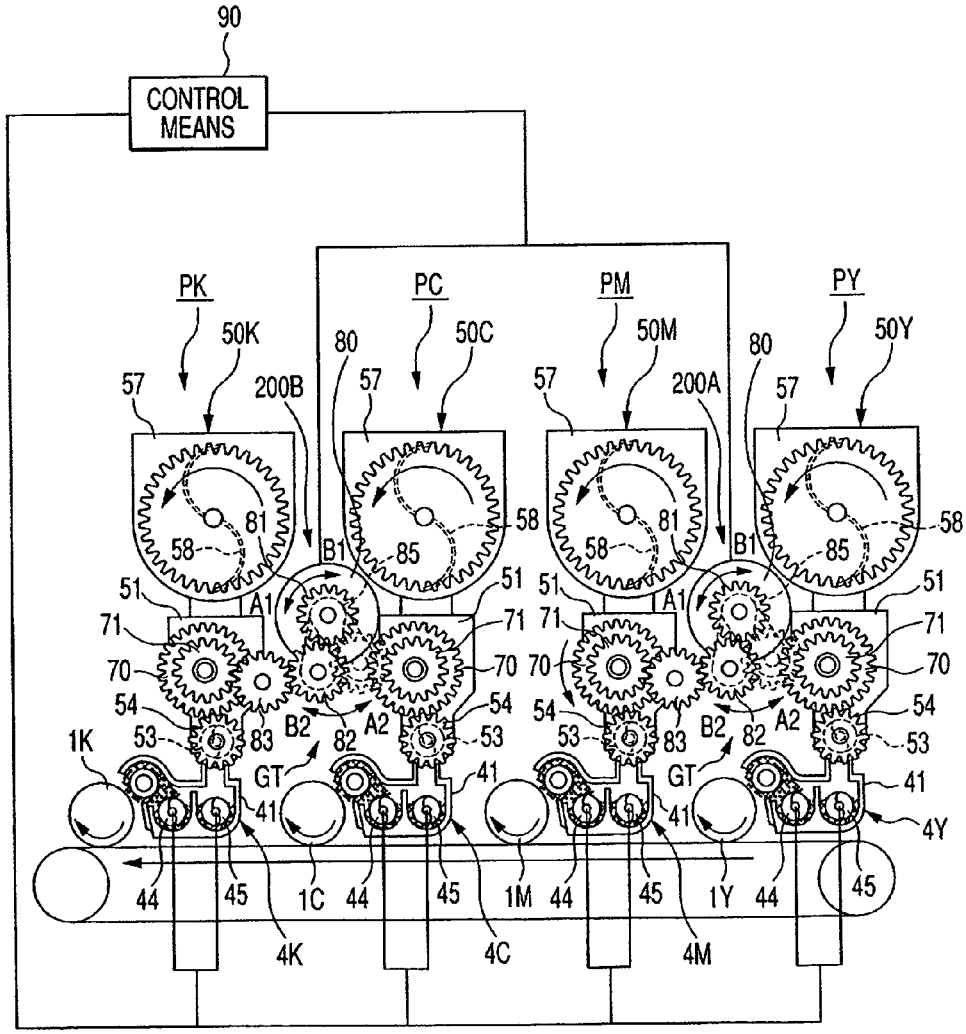
FIG. 10 schematically illustrates the construction of an image forming apparatus according to another embodiment of the present invention using a driving mechanism for a developer supplying apparatus and a developing apparatus.

Reference is first had to FIG. 10 to briefly describe the developing apparatuses 4 and the developer supplying apparatuses 50. The developing apparatuses 4 (4Y, 4M, 4C, 4K) each have a developing screw 44 and an agitating screw 45 which are developer agitating means for agitating and carrying a developer in the developing apparatus 4. Also, the developer supplying apparatuses 50 (50Y, 50M, 50C, 50K) each have a sub-toner container 51 as a first developer container storing therein a developer (toner) to be supplied to the developing apparatus 4, a supply screw 53 as first supplying means for discharging the toner from the sub-toner container 51 and supplying it to the developing apparatus 4, a main toner container 57 as a second developer container storing therein the toner to be supplied to the sub-toner container 51, and an agitating and carrying member 58 as second supplying means for discharging the toner from the main toner container 57 and supplying it to the sub-toner container 51.

According to the present embodiment, the developer supplying apparatuses 50Y and 50M of the yellow developing apparatus (first developing apparatus) 4Y and the magenta developing apparatus (second developing apparatus) 4M, respectively, provided in a yellow image forming station PY and a magenta image forming station PM located downstream of the yellow image forming station PY with respect to the image forming direction, respectively, are driven by a first driving mechanism 200A. Also, likewise, the developer supplying apparatuses 50C and 50K of the cyan developing apparatus (first developing apparatus) 4C and the black developing apparatus (second developing apparatus) 4K, respectively, provided in a cyan image forming station PC and a black image forming station PK located downstream of the cyan image forming station with respect to the image forming direction, respectively, are driven by a second driving mechanism 200B. The first driving mechanism 200A and the second driving mechanism 200B are similar in construction and function to each other, and accordingly, the first driving mechanism 200A will hereinafter be described.

The driving mechanism 200A for the developer supplying apparatus 50 has a motor 80 which is rotatively driving means capable of transmitting a drive to the supply screw 53, and a drive gear train GT as rotation transmitting means capable of transmitting the rotation of the motor 80 to the supply screw 53.

The agitating and carrying member 58 can transmit the drive from the motor 80 to a drive gear 59 through a drive gear train (not shown), but can also be driven by the use of a motor discrete from the motor 80.

Further describing, the drive gear train GT for transmitting the drive to the supply screw 53 has a first drive gear 81 on the motor 80 side, and a second drive gear 82 meshing with this first drive gear 81. The second drive gear 82 is rotatably supported by a rockable lever member 85 rockable about the center of rotation of the first drive gear 81. The rockable lever member 85 is automatically rockable in the rotation direction of the first drive gear 81, but driving means such as, for example, an electromagnetic solenoid may be provided to rockably drive the rockable lever member 85.

The second drive gear 82 operates the rockable lever member 85 to thereby mesh with the first screw gear 71 in order to transmit the drive to the supply screw 53 side of the first developing apparatus (i.e., the yellow developing apparatus) 4Y, or mesh with the first screw gear 71 through a third drive gear 83 in order to transmit the drive to the supply screw 53 side of the second developing apparatus (i.e., the magenta developing apparatus) 4M.

That is, the drive gear train GT is changeover means capable of changing over the rotation of the motor 80 to at least two states, i.e., a first state in which it can transmit the drive to the supply screw 53 side of the first developing apparatus 4Y, and a second state in which it can transmit the drive to the supply screw 53 side of the second developing apparatus 4M.

The control means 90 controls the forward and reverse rotation and stoppage of the motor 80, and as required, the rocking movement of the rockable lever member 85. The control means 90 also controls the rotation and stoppage of the developer agitating means, i.e., the developing screw 44 and the carrying screw 45, of the developing apparatus 4.

As the result, when the motor 80 is rotated in the direction of arrow A1, the lever member 85 is pivotally moved in the direction of arrow A2 to thereby transmit the drive, and when conversely, the motor 80 is rotated in the direction of arrow B1, the lever member 85 is pivotally moved in the direction of arrow B2 to thereby transmit the drive.

As described above, the drive gear train GT includes the rockable lever member 85 and therefore, the control means 90 changes over the rotation direction of the motor 80, whereby the drive gear train GT can act as changeover means capable of changing the rotation of the motor 80 to the two states, i.e., the first state in which it can be transmitted to the supply screw 53 of the first developing apparatus 4Y side, and the second state in which it can be transmitted to the supply screw 53 of the second developing apparatus 4M side.

By the construction as described above, when the supply screw 53 of the first developing apparatus 4Y side is to be rotated to thereby supply the toner from the sub-toner container 51 to the developing apparatus 4Y, if the motor 80 is rotated in the direction of arrow A1, it is possible to rotate the supply screw 53 of the first developing apparatus 4Y side with the supply screw 53 of the second developing apparatus 4M side remaining stopped. Also, when the supply screw 53 of the second developing apparatus 4M side is to be rotated to thereby supply the toner from the sub-toner container 51 to the second developing apparatus 4M, if the motor 80 is rotated in the direction of arrow B1, it is possible to rotate the supply screw 53 of the second developing apparatus 4M side with the supply screw 53 of the first developing apparatus 4Y side remaining stopped. Accordingly, as compared with the conventional example, one motor can be curtailed and therefore, the simplification, downsizing and lower cost of the image forming apparatus can be realized.

Also, the timing at which the supply screws 53 start their rotation and are stopped and the toner supply mode are similar to those shown in FIGS. 3 to 9 of Embodiment 1, and an operational effect similar to that of Embodiment can be achieved.

In the present embodiment, as shown in FIGS. 1 and 2, the image forming apparatus is an image forming apparatus in which developing apparatuses for four colors are provided side by side, and the above-described construction and operation mode to the yellow developing apparatus 4Y and the magenta developing apparatus 4M can also be applied to the cyan developing apparatus 4C and the black developing apparatus 4K adjacent thereto, to thereby achieve a similar operational effect.

According to the present invention, however, the image forming apparatus is not restricted to the image forming apparatus in which the developing apparatuses for four colors are provided side by side, but if there are two or more developing apparatuses, a similar effect can be obtained, and of course, it is also possible to apply the present embodiment to only two of the four colors, and adopt the conventional construction in the other developing apparatuses.

Embodiment 3

Description will now be made of a third embodiment of the image forming apparatus of the present invention. Again in this embodiment, the image forming apparatus, the developing apparatuses and the developer supplying apparatuses are made similar in construction to the image forming apparatus, the developing apparatuses and the developer supplying apparatuses described in Embodiment 1. Accordingly, the description of Embodiment 1 is invoked for the detailed description of the general constructions of the image forming apparatus, the developing apparatuses and the developer supplying apparatuses, and the description thereof need not be made again, and the driving constructions and operations of the developing apparatuses and the developer supplying apparatuses which form the features of the present embodiment will hereinafter be described.

Figure 11:
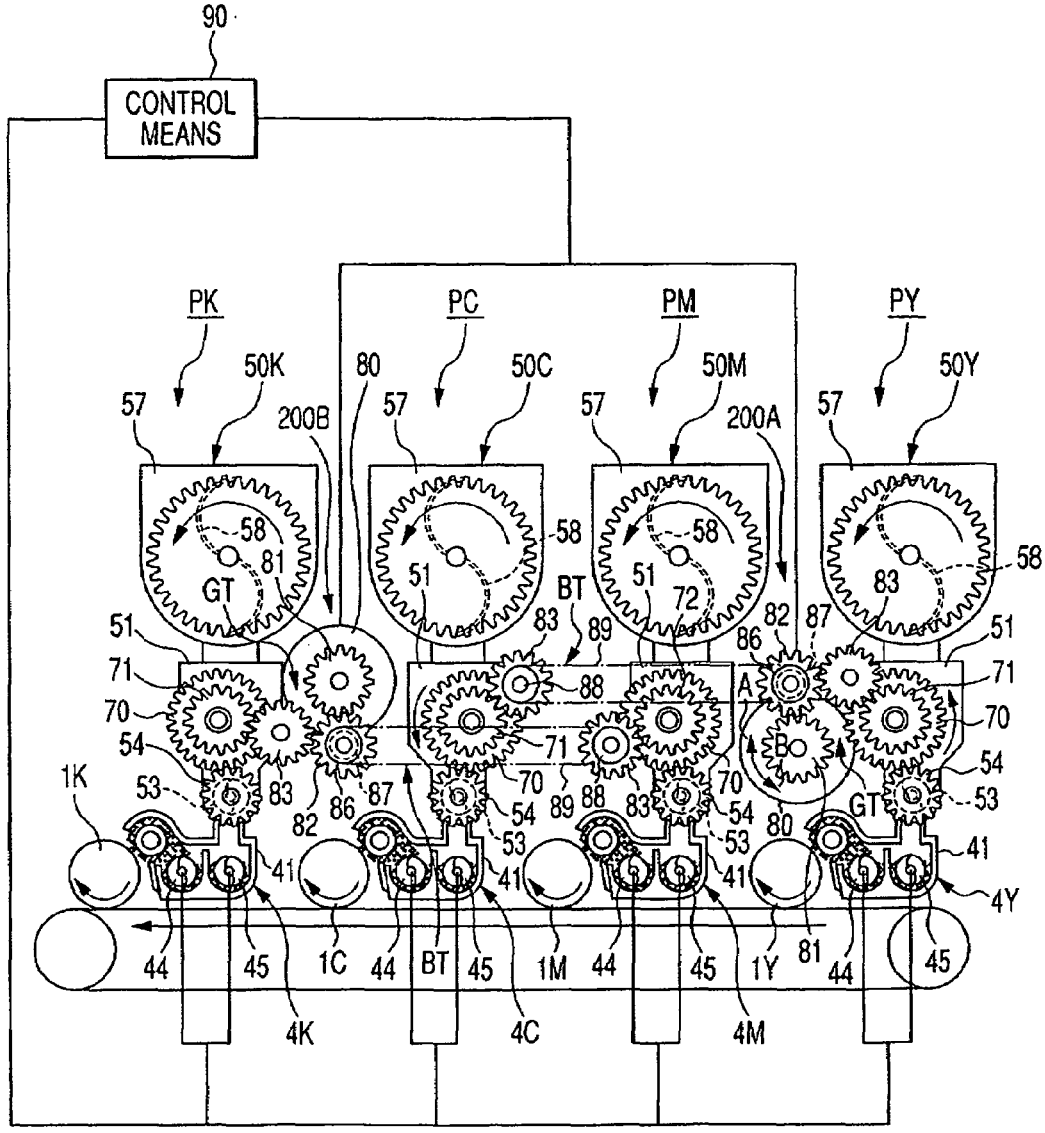
FIG. 11 schematically illustrates the construction of an image forming apparatus according to another embodiment of the present invention using a driving mechanism for a developer supplying apparatus and a developing apparatus.

Reference is first had to FIG. 11 to briefly describe the developing apparatus 4 and the developer supplying apparatus 50. The developing apparatus 4 has a developing screw 44 and an agitating screw 45 which are developer agitating means for agitating and carrying the developer in the developing apparatus 4. Also, the developer supplying apparatus 50, as described above, has the sub-toner container 51 as the first developer container storing therein the developer (toner) to be supplied to the developing apparatus 4, the supply screw 53 as the first supplying means for discharging the toner from the sub-toner container 51 and supplying it to the developing apparatus 4, the main toner container 57 as the second developer container storing therein the toner to be supplied to the sub-toner container 51, and the agitating and carrying member 58 as the second supplying means for discharging the toner from the main toner container 57 and supplying it to the sub-toner container 51.

According to the present embodiment, the developer supplying apparatuses 50Y and 50C of the yellow developing apparatus (first developing apparatus) 4Y and the cyan developing apparatus (second developing apparatus) 4C provided in the yellow image forming station PY and the cyan image forming station PC next but one to the yellow image forming station PY and located downstream of the yellow image forming station PY with respect to the image forming direction, respectively, are driven by a first driving mechanism 200A. Also, likewise, the developer supplying apparatuses 50M and 50K of the magenta developing apparatus (first developing apparatus) 4M and the black developing apparatus (second developing apparatus) 4K provided in the magenta image forming station PM and the black image forming station PK next but one to the magenta image forming station PM and located downstream of the magenta image forming station PM with respect to the image forming direction, respectively, are driven by a second driving mechanism 200B. The first driving mechanism 200A and the second driving mechanism 200B are similar in construction and function to each other, and accordingly, the first driving mechanism 200A will hereinafter be described.

The driving mechanism 200A for the developer supplying apparatuses 50 has a motor 80 which is rotatively driving means capable of transmitting a drive to the supply screw 53, a drive gear train GT as rotation transmitting means capable of transmitting the rotation of the motor 80 to the supply screw 53 of the first developing apparatus 4Y side, and belt driving means BT as rotation transmitting means capable of transmitting the rotation of the motor 80 to the supply screw 53 of the second developing apparatus 4C side.

The agitating and carrying member 58 can transmit a drive from the motor 80 to a drive gear 59 through a drive gear train (not shown), but can also be driven by the use of a motor discrete from the motor 80. Further describing, the drive gear train GT for transmitting the drive to the supply screw 53 of the first developing apparatus (i.e., the yellow developing apparatus) 4Y side has a first drive gear 81 on the motor 80 side, and second and third drive gears 82 and 83 meshing with this first drive gear 81. The third drive gear 83 meshes with a first screw gear 71 to transmit the drive to the supply screw 53 side of the first developing apparatus 4Y. The first screw gear 71 drives the supply screw 53 through a second screw gear 70 and a third screw gear 54. Also, the second drive gear 82 is connected to a wheel, e.g. a toothed wheel 86, constituting the belt driving means BT through a one-way clutch 87 to transmit the drive to the supply screw 53 side of the second developing apparatus (i.e., the cyan developing apparatus) 4C.

The belt driving means BT has the toothed wheel 86, a toothed wheel 88 disposed on the second developing apparatus 4C side, and a belt, i.e., a toothed belt 89, wound between the two wheels 86 and 88. The toothed wheel 88 is connected to the third drive gear 83 of the second developing apparatus 4C side.

That is, according to the present embodiment, the drive gear train GT and the belt driving means BT are changeover means capable of changing over the rotation of the motor 80 to a first state in which it can be transmitted to the supply screw 53 for the first developing apparatus 4Y, and a second state in which it can be transmitted to the supply screw 53 for the second developing apparatus 4C.

Control means 90 controls the forward and reverse rotation and stoppage of the motor 80. Also, the control means 90 controls the rotation and stoppage of the developer agitating means, i.e., the developing screw 44 and the carrying screw 45, of the developing apparatus 40.

Also, the one-way clutch 87 is designed to transmit rotation in one direction, but not to transmit rotation in the opposite direction and therefore, when the motor 80 is rotated in the direction of arrow A, the one-way clutch 87 idly rotates, and when conversely, the motor 80 is rotated in the direction of arrow B, the one-way clutch 87 transmits the driving force of the second drive gear 82 to the wheel 86.

As the result, when the motor 80 is rotated in the direction of arrow A, the supply screw 53 of the first developing apparatus 4Y is rotated with the supply screw 53 of the second developing apparatus 4C side remaining stopped, and when the motor 80 is rotated in the direction of arrow B, the supply screw 53 of the second developing apparatus 4C side is rotated with the supply screw 53 of the first developing apparatus 4Y side remaining stopped.

As described above, the drive gear train GT and the belt driving means BT include the one-way clutch 87 and therefore, the control means 90 changes over the rotation direction of the motor 80, whereby the drive gear train GT and the belt driving means BT can act as changeover means capable of changing over the rotation of the motor 80 to the two states, i.e., the first state in which it can be transmitted to the supply screw 53 of the first developing apparatus 4Y side, and the second state in which it can be transmitted to the supply screw 53 of the second developing apparatus 4C side.

By the construction as described above, when the supply screw 53 of the first developing apparatus 4Y side is to be rotated to thereby supply the toner from the sub-toner container 51 to the developing apparatus 4Y, if the motor 80 is rotated in the direction of arrow A, it is possible to rotate the supply screw 53 of the first developing apparatus 4Y side with the supply screw 53 of the second developing apparatus 4C side remaining stopped. Also, when the supply screw 53 of the second developing apparatus 4C side is to be rotated to thereby supply the toner from the sub-toner container 51 to the second developing apparatus 4C, if the motor 80 is rotated in the direction of arrow B, it is possible to rotate the supply screw 53 of the second developing apparatus 4C side with the supply screw 53 of the first developing apparatus 4Y side remaining stopped. Accordingly, as compared with the conventional example, one motor can be eliminated and therefore, the simplification, downsizing and lower cost of the image forming apparatus can be realized.

Again in the present embodiment, as in Embodiment 1, the timing at which the supply screw 53 starts its rotation and is stopped is restricted to the time when the agitating means 44 and 45 of the developing apparatus 4 are rotated.

Figure 12:
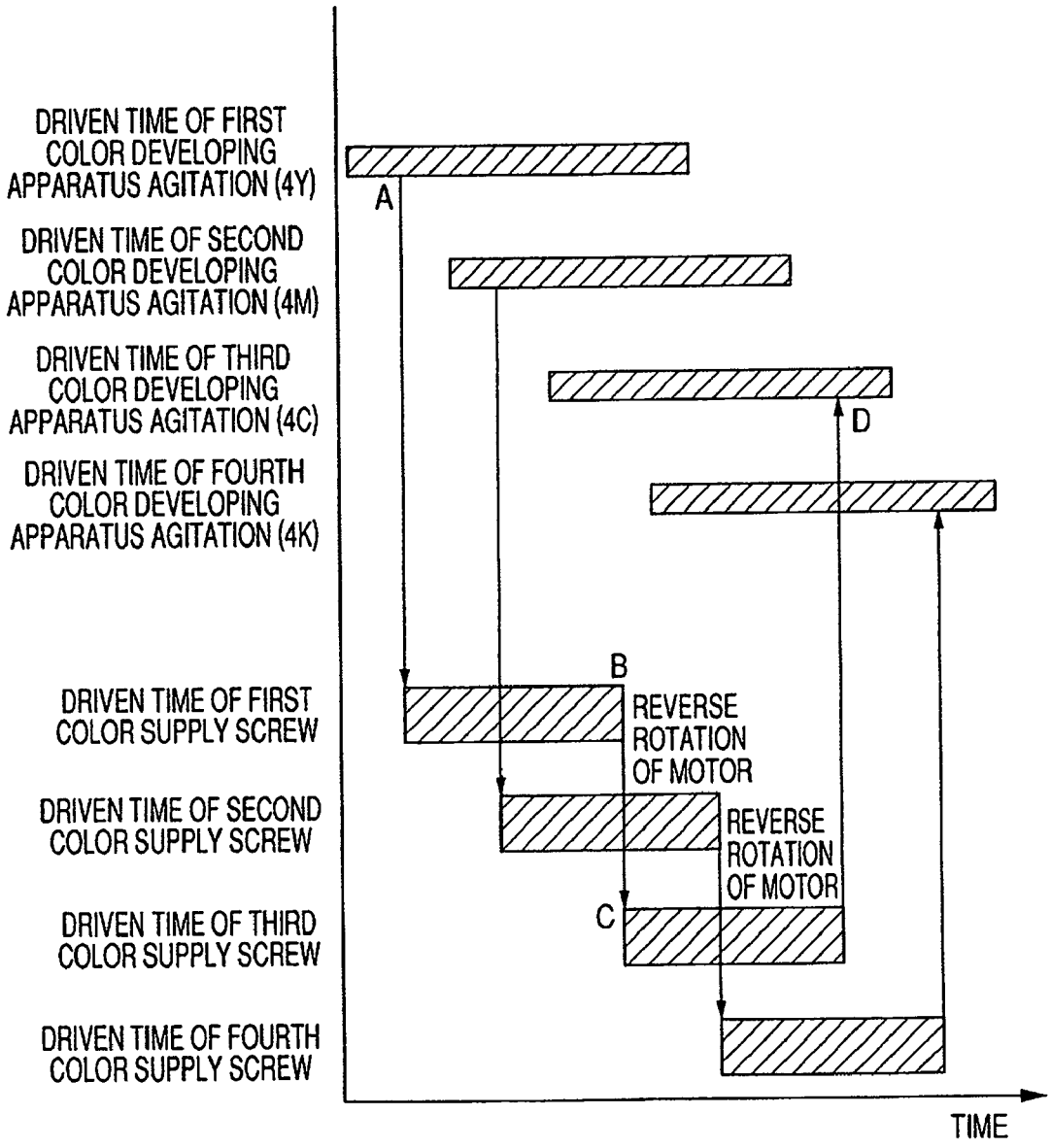
FIG. 12 illustrates the timing of the rotation and stoppage of the developer agitating means (agitating screw and developing screw) of a developing apparatus and the supply screw of a developer supplying apparatus in another embodiment of the present invention.

That is, FIG. 12 shows the timing, and the control means 90 is set so that after the agitating means 44 and 45 of the first developing apparatus 4Y have started their rotation, the rotation of the supply screw 53 of the first developing apparatus 4Y may be started (A in FIG. 12), and after the rotation of the supply screw 53 of the first developing apparatus 4Y has been stopped, the agitating means 44 and 45 of the first developing apparatus 4Y may be stopped (B in FIG. 12), and after the agitating means 44 and 45 of the second developing apparatus 4C have started their rotation, the rotation of the supply screw 53 of the second developing apparatus 4C may be started (C in FIG. 12), and after the rotation of the supply screw 53 of the second developing apparatus 4C has been stopped, the agitating means 44 and 45 of the second developing apparatus 4C may be stopped (D in FIG. 12).

It can be seen that in the above-described operation mode of the present embodiment, as compared with the operation mode shown in FIG. 3, the time for which the supply screws 53 can be rotated becomes long.

This is because the combination of the developing apparatuses sharing the motor 80 for driving the supply screw 53 is not that of the developing apparatuses adjacent to each other, but that of the developing apparatuses next but one to each other by the utilization of the timing belt.

The ability to secure a long time for which the supply screw 53 is rotated leads to the ability to reduce the speed of the supply screw 53, which in turn leads to the merits that (1) the electric power consumption by the motor 80 can be reduced, (2) the supply accuracy can be improved, and (3) the toner is carried into the developing apparatus little by little and therefore, it is difficult for the uneven density of the toner in the developing apparatus to occur.

Accordingly, in the present embodiment, the drive gear train GT and the belt driving means BT are required and as compared with Embodiment 1, the mechanism becomes complicated, but the higher quality of product can be achieved.

Again in the present embodiment, as in Embodiment 1, the toner supplying mode shown in FIGS. 4 to 9 can be applied, and an operational effect similar to that of Embodiment 1 can be achieved.

In the present embodiment, as shown in FIG. 11, the image forming apparatus is an image forming apparatus in which developing apparatuses for four colors are provided side by side, and the above-described construction and operation mode to the yellow developing apparatus 4Y and the cyan developing apparatus 4C can also be applied to the magenta developing apparatus 4M and the black developing apparatus 4K next but one thereto, to thereby achieve a similar operational effect.

According to the present invention, however, the image forming apparatus is not restricted to an image forming apparatus in which developing apparatuses for four colors are provided side by side, but if there are three or more developing apparatuses, a similar effect can be obtained, and of course, it is also possible to apply the present embodiment to only two of the four colors, and adopt the conventional construction in the other developing apparatuses.

Embodiment 4

Description will now be made of a fourth embodiment of the image forming apparatus of the present invention. Again in this embodiment, the image forming apparatus, the developing apparatuses and the developer supplying apparatuses are made similar in construction to the image forming apparatus, the developing apparatuses and the developer supplying apparatuses described in Embodiment 1 with reference to FIGS. 1 and 2. Accordingly, the description of Embodiment 1 is invoked for the detailed description of the general constructions of the image forming apparatus, the developing apparatuses and the developer supplying apparatuses, and the description thereof need not be made again, and description will be made of the driving constructions and operations of the developing apparatuses and the developer supplying apparatuses which form the features of the present embodiment.

Figure 13:
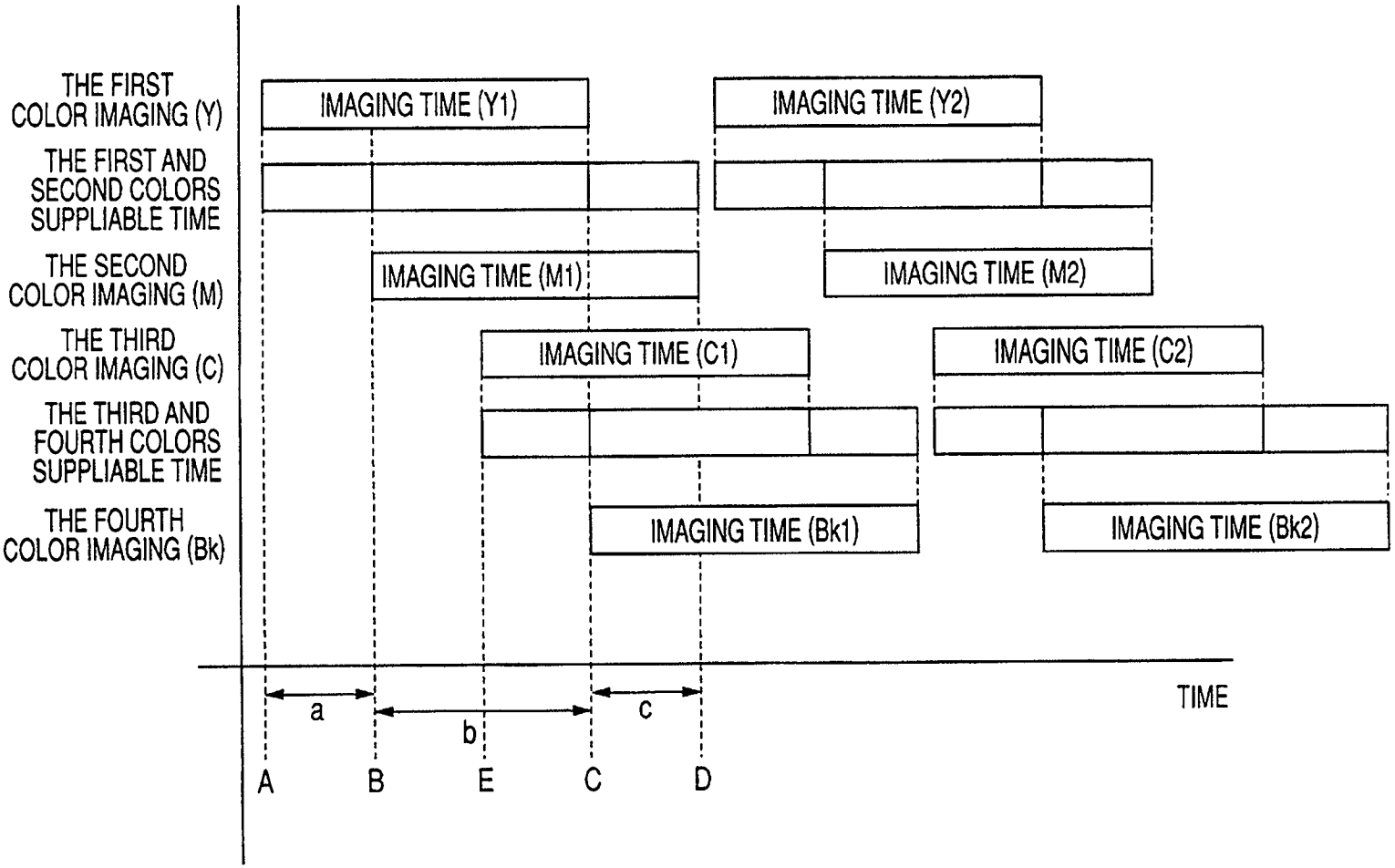
FIG. 13 illustrates the timing of the rotation and stoppage of the developer agitating means (agitating screw and developing screw) of a developing apparatus and the supply screw of a developer supplying apparatus in another embodiment of the present invention.

FIG. 13 is an operation timing diagram showing the control modes of the developing apparatuses and the developer supplying apparatuses in the present embodiment.

In Embodiment 1, as shown in FIG. 2, the driving for the supply screw 53 of the first developing apparatus, i.e., the yellow developing apparatus 4Y side, and the supply screw 53 of the second developing apparatus, i.e., the magenta developing apparatus 4M side is by only one motor 80 and therefore, as shown in FIG. 13, the total suppliable time of the toners of these two colors is a time A to D.

Also, the maximum supply of each color is used as the imaging time of each color, whereby a maximum supply time is used so as to secure the agitating time sufficiently.

Here, the space between A-B(a) and between C-D(c) is the distance between the photosensitive drums of these two colors, i.e., the yellow photosensitive drum 1Y and the magenta photosensitive drum 1M (the distance Q in FIG. 19), and is a delay time occurring in effecting image formation. The space between B-C(b) is a time zone in which imaging is effected for two colors at a time. If the spacings between adjacent photosensitive drums are all set to the same, the maximum suppliable time of each color is between A-C (=between B-D), and the maximum suppliable time is t=a+b for the yellow developing apparatus 4Y, and is t=b+c for the magenta developing apparatus 4M. The toner supply time required in each developing apparatus is determined by the image density (printing rate) to be developed by each developing apparatus. That is, as the image density becomes higher, the amount of consumed toner becomes greater and therefore, the supply time becomes longer so as to increase the amount of toner to be supplied.

In the present embodiment, the changeover point of the forward and reverse rotation of the motor 80 is made variable between B-C, whereby it becomes possible to flexibly supply a necessary amount to each developing apparatus.

When the reference changeover point is defined as a point B, the case is classified as follows.

(1) When the supply time ty of the yellow developing apparatus 4Y is ty<a, the changeover point remains being the point B.

(2) When the supply time ty of the yellow developing apparatus 4Y is a+b>ty>a and the supply time tm of the magenta developing apparatus 4M is tm<c, the changeover point is between B-C, and as soon as ty ends, the rotation direction is reversed and the toner is supplied for tm.

(3) When the supply time ty of the yellow developing apparatus 4Y is a+b>ty>a and the supply time tm of the magenta developing apparatus 4M is tm>c, the sum total of the toner supply times exceeds the drivable time of the motor 80.

The present embodiment particularly corresponds to the case (3) above.

The changeover point of toner supply is between B-C, and the changeover point is determined by the ratio of the toner supply times ty and tm to thereby determine the changeover point.

Figure 14B:
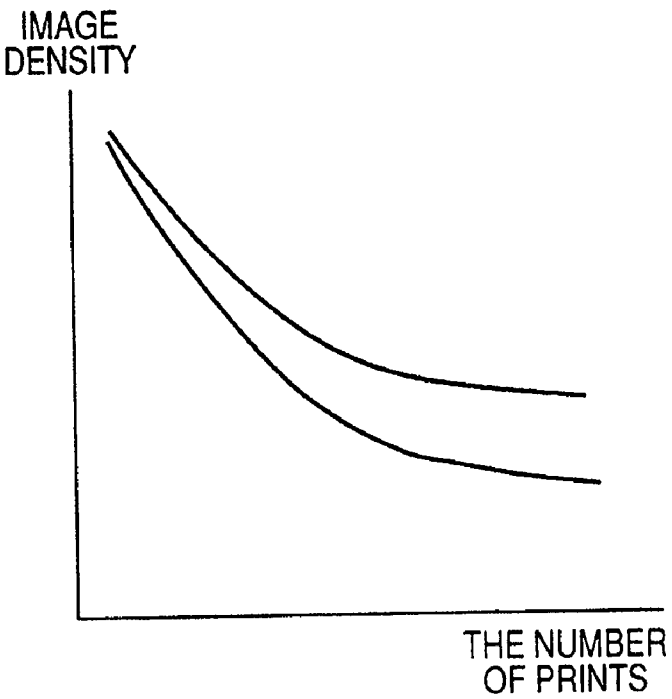
FIG. 14B is a typical view showing a density fluctuation according to a conventional example.
Figure 14A:
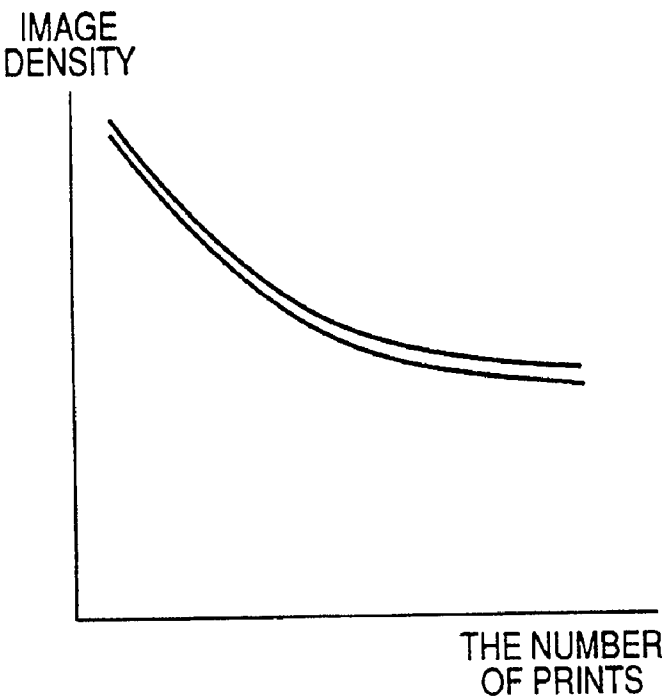
FIG. 14A is a typical view showing a density fluctuation according to the present invention.

FIG. 14A is a typical graph showing the density fluctuation when toner supply was effected at the same proportion as when for all colors, the same high print proportion images were continuously printed, and FIG. 14B is a typical graph showing the density fluctuation when partial toner supply time allotment was effected when high print proportion images were continuously effected.

During the imaging time, i.e., in a state in which the developing apparatus is being driven, whereby the agitation in the developing apparatus is acting, toner supply is effected and as shown in FIG. 14B, the extreme curtailment of the toner supply time only for one color is eliminated, whereby the fluctuation of image density can be suppressed.

That is, as shown in FIG. 14A, the respective colors density-fluctuate in the same manner, whereby the fluctuation of color taste can be made apparently small.

According to the present embodiment, it is possible to suppress the occurrence of toner scattering or background fog due to the faulty agitation of the toner liable to occur during a lower cost, speedup or downsizing, and a good output image can be obtained.

Embodiment 5

Description will now be made of a fifth embodiment of the present invention.

In Embodiment 4, it is explained, the measure of the tendency in which the density gradually falls depending on the decrease of the toner to be supplied which is equal to or less than that corresponding to t=b/2 as a supply time, when the first developing apparatus (yellow developing apparatus) 4Y and the second developing apparatus (magenta developing apparatus) 4M adjacent to each other continuously form images of a print proportion of 100%.

Although depending on the time b, the above-described tendency is exhibited for a print proportion of the order of 70% or greater, but considering from a usually used print proportion, this is considered to be a rare case.

However, by adopting the following construction in view of these inconveniences, it is possible to suppress toner scattering, background fog and density fluctuation.

Figure 15:
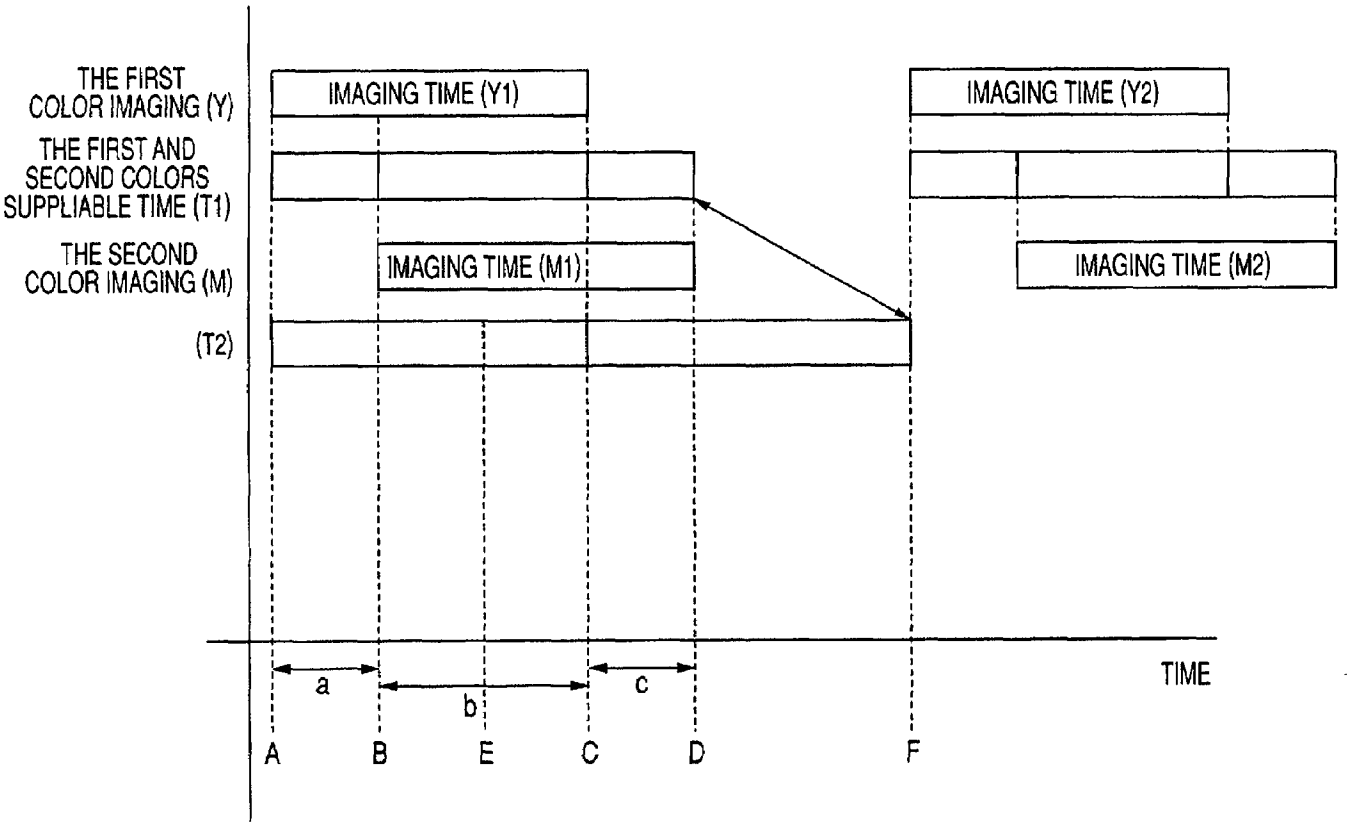
FIG. 15 illustrates the timing of the rotation and stoppage of the developer agitating means (agitating screw and developing screw) of a developing apparatus and the supply screw of a developer supplying apparatus in another embodiments of the present invention.

As shown in FIG. 15, when maximum supply is required for two colors at a time, it is necessary to change over the supply at a point E. The amount of supply is primarily determined by the supply time and speed and therefore, the deficiency of the amount of supply can be converted into the number of driving revolutions of the motor.

Considering under the condition that the amount of supply is proportional to the above-mentioned conditions, the speedup of the number of revolutions $M(r)=(a+b)/(a+b-(b/2))=(a+b)/(a+b/2)$ becomes necessary in maximum, and by determining the number of revolutions of the motor so that the sum total of the supply times using the above-mentioned motor may not exceed the driving time, it is possible to prevent the circumstance of the deficiency of the amount of supply during a high print proportion, and obtain a stable output image free of faulty agitation or background fog.

Embodiment 6

Description will now be made of a sixth embodiment of the present invention.

While in Embodiment 5, the object has been achieved by increasing the rotation of the driving motor 80 for the supply screw 53, the following construction is also effective as other means.

As regards the supply of the developer, it is effected during image formation, i.e., during the time when the developing apparatus is operated and the agitation of the toner is possible, whereby the developing apparatus is operated so as to eliminate faulty agitation.

Usually, in a non-image forming area (such as the interval between sheets), the operation is stopped to avoid the trouble of the life or the like of the developing apparatus. However, only in the rare case of a high print proportion, in order to make up for the deficiency of the supply time, a zero image by the developing apparatus is formed with a part or the whole of the time from after the termination of image formation till the start of the next image formation (such as the interval between sheets or during post-rotation) regarded as a printing rate of zero, whereby the toner supply time is lengthened.

In the present embodiment, image formation is effected up to a point F in FIG. 15 to thereby extend the time for which the toner can be supplied. Depending on the overtime of the supply time, the distance between formed images during the continuous copying of plural sheets can be controlled to thereby secure a necessary supply time.

That is, when the sum total of the toner supply times exceeds the drivable time of the motor, the driving of the motor is also effected in the non-image forming areas among a plurality of image forming areas, to thereby effect the supply of the toner.

By controlling as described above, it is possible to eliminate the faulty agitation of the toner, eliminate such inconveniences as scattering, background fog and density fluctuation, and obtain a good output image.

This application claims priority from Japanese Patent Application No. 2005-010966 filed on Jan. 18, 2005, which is hereby incorporated by reference herein.

What is claimed is:

1. An image forming apparatus comprising:

a first developing apparatus for developing an electrostatic image formed on a first image bearing member with a developer;

a second developing apparatus for developing an electrostatic image formed on a second image bearing member disposed downstream of said first image bearing member with respect to a direction in which a transfer medium to which a developer image is transferred is conveyed, with a developer;

a first developer container containing therein a developer to be supplied to said first developing apparatus;

first supplying means for supplying said developer to be supplied in said first developer container to said first developing apparatus;

a second developer container containing therein a developer to be supplied to said second developing apparatus;

second supplying means for supplying said developer to be supplied in said second developer container to said second developing apparatus;

driving means for generating a driving force for driving said first supplying means and said second supplying means;

changeover means capable of changing a driving force of said driving means over in at least two states including a first state and a second state during one image forming operation, the first state transmitting the driving force of said driving means to said first supplying means, said second state transmitting the driving force of said driving means to said second supplying means; and control means for changing the time of said first state and the time of said second state during said one image forming operation, in conformity with an image to be formed.

2. An image forming apparatus according to claim 1, wherein said changeover means is provided with at least one one-way clutch.

3. An image forming apparatus according to claim 1, wherein said changeover means is provided with first and second gears meshing with each other, and a lever member rockable about the center of rotation of said second gear rotatably supporting said first gear.

4. An image forming apparatus according to claim 1, wherein said control means changes the time of said first state and the time of said second state in conformity with the density of the image to be developed by said first developing apparatus and the density of the image to be developed by said second developing apparatus.

5. An image forming apparatus according to claim 1, further comprising:

first agitating means for agitating the developer in said first developing apparatus; and second agitating means for agitating the developer in said second developing apparatus;

wherein said control means controls so as to start drive transmission to said first supplying means after the agitation by said first developing apparatus is started, stop the drive transmission to said first supplying means before the agitation by said first developing apparatus is stopped, start drive transmission to said second supplying means after the agitation by said second developing apparatus is started, and stop the drive transmission to said second supplying means before the agitation by said second developing apparatus is stopped.

6. An image forming apparatus according to claim 1, further comprising:

supply amount controlling means capable of changing the amounts of supply of the developers to be supplied per unit time by said first and second supplying means.

7. An image forming apparatus according to claim 6, wherein said supply amount controlling means, when it controls the amount of supply per unit time by the first or second supplying means, controls so as to more increase the amount of supply per unit time as the density of the developed image by the pertinent developing apparatus becomes higher.

8. An image forming apparatus according to claim 6, wherein said supply amount controlling means, when it controls the amount of supply per unit time by the first or second supplying means, controls so as to more increase the amount of supply per unit time as the length of a recording material to which visible images on said image bearing members are transferred in a direction orthogonal to the conveying direction of the recording material becomes greater.

9. An image forming apparatus according to claim 6, wherein said supply amount controlling means, when it controls the amount of supply per unit time by the first or second supplying means, controls so as to more increase the amount of supply per unit time as an image forming speed becomes higher.

10. An image forming apparatus according to claim 1, wherein at least two developing apparatuses are provided side by side in a direction in which said transfer medium is conveyed, and said first developing apparatus and said second developing apparatus are at locations adjacent to each other.

11. An image forming apparatus according to claim 1, wherein at least three developing apparatuses are provided side by side in a direction in which said transfer medium is conveyed, and said first developing apparatus and said second developing apparatus are at locations not adjacent to each other.

12. An image forming apparatus according to claim 1, wherein the maximum developer supply times of said first and second supplying means are the operation times of said first and second developing apparatuses, the drivable time of said driving means is from the start till the end of the operations of said first and second developing apparatuses, and changeover timing by said changeover means differs depending on the sum total of the supply times of the developers to be supplied by said first and second supplying means.

13. An image forming apparatus according to claim 12, wherein when the sum total of the supply times of said developers to be supplied exceeds the drivable time of said driving means, said changeover timing is determined by the ratio of the supply times of the developers to be supplied.

14. An image forming apparatus according to claim 12, wherein when the supply times of the developers to be supplied which are the driving times of said first and second supplying means receiving a drive by said driving means exceed a predetermined time, the number of driving revolutions of said driving means is changed over.

15. An image forming apparatus according to claim 14, wherein the sum total of the supply times of said developers to be supplied exceeds the drivable time of said driving means, the number of driving revolutions of said driving means is changed over.

16. An image forming apparatus according to claim 14, wherein when the sum total of the supply times of said developers to be supplied exceeds the drivable time of said driving means, the driving of said driving means is also effected in non-image forming areas among a plurality of image forming areas to thereby effect the supply of the developers to be supplied.

17. An image forming apparatus according to claim 16, wherein the supply time in said non-image forming areas is variable by the sum total of the supply times of said developers to be supplied.

* * * * *